US010509337B2

(12) United States Patent
Shimizu

(10) Patent No.: US 10,509,337 B2
(45) Date of Patent: Dec. 17, 2019

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventor: Tomofumi Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/000,674

(22) Filed: Jun. 5, 2018

(65) Prior Publication Data

US 2018/0356744 A1 Dec. 13, 2018

(30) Foreign Application Priority Data

Jun. 12, 2017 (JP) ..... 2017-114931

(51) Int. Cl.
*G03G 5/06* (2006.01)

(52) U.S. Cl.
CPC ..... *G03G 5/0618* (2013.01); *G03G 5/0603* (2013.01); *G03G 5/0607* (2013.01); (Continued)

(58) Field of Classification Search
CPC .. G03G 5/0614; G03G 5/0616; G03G 5/0603; G03G 5/0607; G03G 5/0609; G03G 5/0638; G03G 5/0631; G03G 5/0618
See application file for complete search history.

(56) References Cited

U.S. PATENT DOCUMENTS 4,474,865 A 10/1984 Ong et al.
5,416,567 A * 5/1995 Toyoshima ..... G03G 15/065 399/254

(Continued)

FOREIGN PATENT DOCUMENTS

JP S60-69657 A 4/1985
JP 05092936 A * 4/1993

(Continued)

OTHER PUBLICATIONS

English language machine translation of WO 2016/159244 (dated Oct. 2016).*

(Continued)

*Primary Examiner* — Christopher D Rodee
(74) *Attorney, Agent, or Firm* — Studebaker & Brackett PC

(57) ABSTRACT

An electrophotographic photosensitive member includes a conductive substrate and a photosensitive layer having a single-layer structure. The photosensitive layer contains a charge generating material, an electron transport material, a polycarbonate resin, and a hole transport material. The electron transport material includes a compound having a halogen atom and represented by general formula (1), (2), (3), (4), or (5). The hole transport material includes a compound represented by general formula (20), (21), (22), (23), (24), (25), (26), or (27). A charge of calcium carbonate as measured by charging the calcium carbonate through friction with the photosensitive layer is at least +6.5 μC/g. A Vickers hardness of the photosensitive layer at 45° C. is at least 17.0 HV.

(1)

(Continued)

-continued
(2)
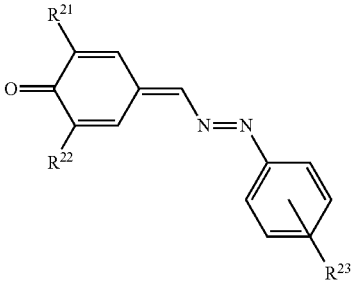
(3)
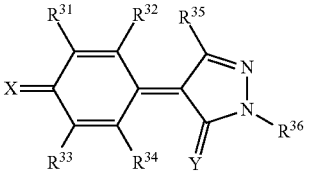
(4)
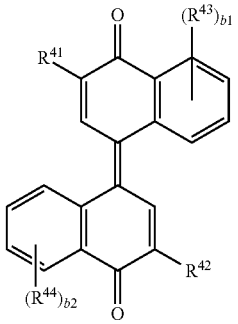
(5)
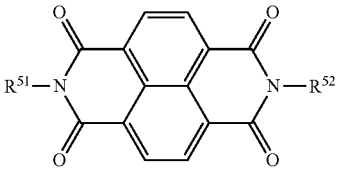
(20)
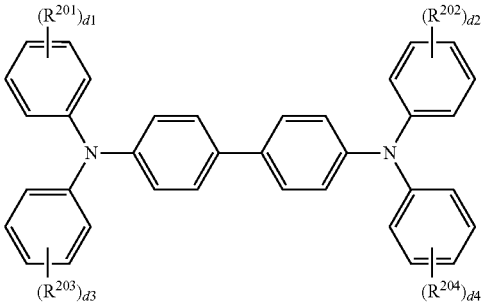
(21)
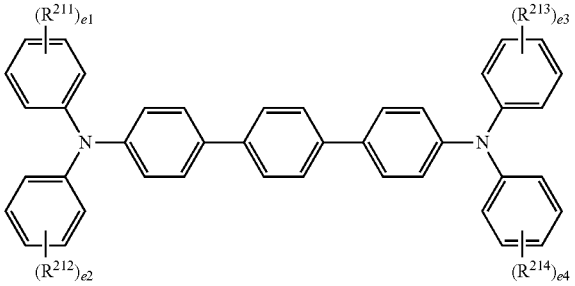
-continued
(22)
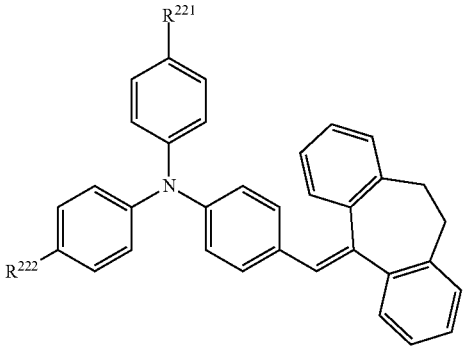
(23)
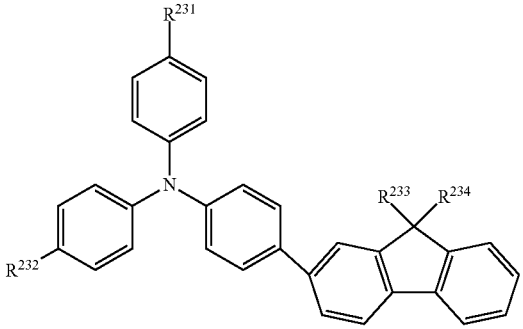
(24)
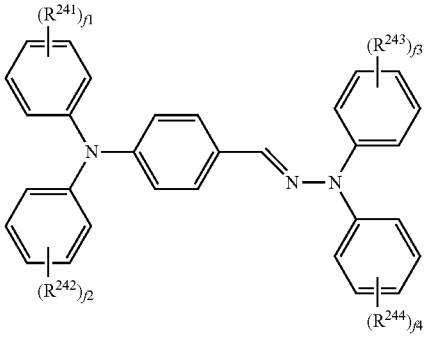
(25)
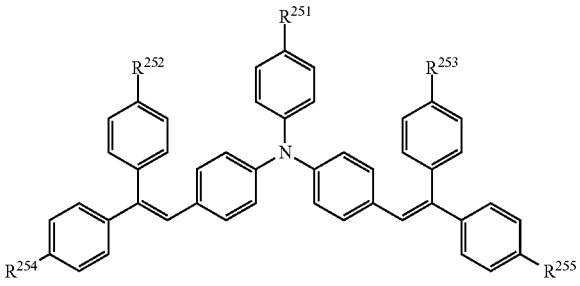

-continued (26)

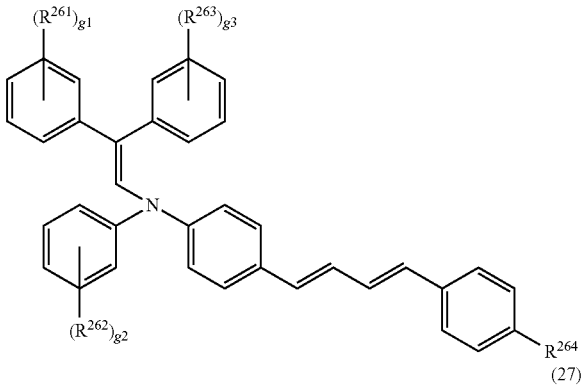

(27)

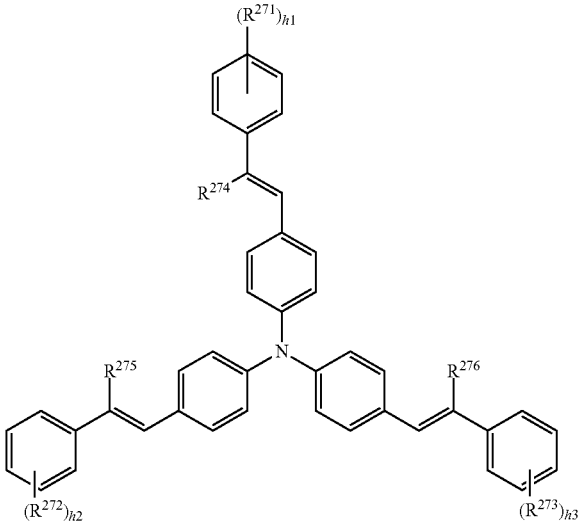

3 Claims, 3 Drawing Sheets

(52) U.S. Cl.
CPC ..... *G03G 5/0609* (2013.01); *G03G 5/0614* (2013.01); *G03G 5/0631* (2013.01); *G03G 5/0638* (2013.01); *G03G 5/0648* (2013.01)

(56) References Cited

U.S. PATENT DOCUMENTS

| | | | | | |
|---|---|---|---|---|---|
| 5,437,953 | A * | 8/1995 | Russell | C09B 69/10 | 430/109.3 |
| 5,532,097 | A * | 7/1996 | Tavernier | G03G 9/0819 | 430/108.2 |
| 2018/0196364 | A1 * | 7/2018 | Yamada | G03G 5/04 | |

FOREIGN PATENT DOCUMENTS

| | | | | |
|---|---|---|---|---|
| JP | 2007192903 | A * | 8/2007 | G03G 5/05 |
| JP | 2016142929 | A * | 8/2016 | |
| JP | 2016180846 | A * | 10/2016 | |
| JP | 2017151254 | A * | 8/2017 | |
| JP | 2017178845 | A * | 10/2017 | |
| JP | 2017227756 | A * | 12/2017 | |
| WO | WO-2016159244 | A1 * | 10/2016 | G03G 5/05 |
| WO | WO-2017145759 | A1 * | 8/2017 | C07C 50/10 |
| WO | WO-2017208700 | A1 * | 12/2017 | G03G 5/05 |

OTHER PUBLICATIONS

English language machine translation of JP 6350316 (dated Jul. 2018).*

English langauge machine translation of JP 2016-180846 (dated Oct. 2016).*

English language machine translation of JP 2017-178845 (dated 2017).*

English language machine translation of WO 2017/208700 (dated 2017).*

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2017-114931, filed on Jun. 12, 2017. The contents of this application are incorporated herein by reference in their entirety.

BACKGROUND

The present disclosure relates to an electrophotographic photosensitive member, a process cartridge, and an image forming apparatus.

An electrophotographic photosensitive member is used as an image bearing member in an electrophotographic image forming apparatus (for example, a printer or a multifunction peripheral). The electrophotographic photosensitive member includes a photosensitive layer. A single-layer electrophotographic photosensitive member or a multi-layer electrophotographic photosensitive member is for example used as the electrophotographic photosensitive member. The single-layer electrophotographic photosensitive member includes a photosensitive layer of a single-layer structure having a charge generation function and a charge transport function. The multi-layer electrophotographic photosensitive member includes a photosensitive layer that includes a charge generating layer having the charge generation function and a charge transport layer having the charge transport function.

The multi-layer electrophotographic photosensitive member includes an electron transport layer. The electron transport layer for example contains an electron transport material represented by chemical formula shown below.

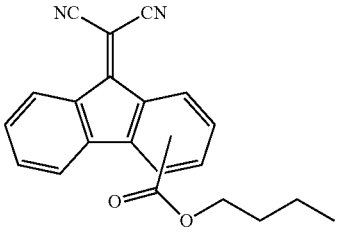

SUMMARY

An electrophotographic photosensitive member according to an aspect of the present disclosure includes a conductive substrate and a photosensitive layer having a single-layer structure. The photosensitive layer contains a charge generating material, an electron transport material, a polycarbonate resin, and a hole transport material. The electron transport material includes a compound having a halogen atom and represented by general formula (1), (2), (3), (4), or (5). The hole transport material includes a compound represented by general formula (20), (21), (22), (23), (24), (25), (26), or (27). A charge of calcium carbonate as measured by charging the calcium carbonate through friction with the photosensitive layer is at least +6.5 μC/g. A Vickers hardness of the photosensitive layer at 45° C. is at least 17.0 HV.

(1)

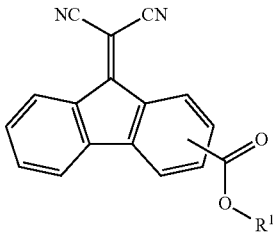

(2)

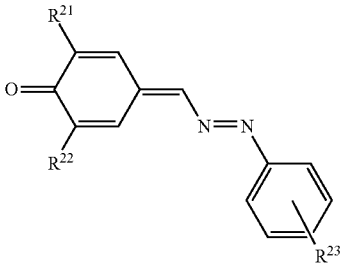

(3)

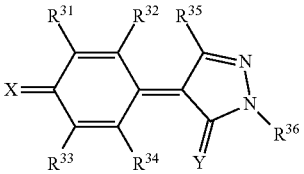

(4)

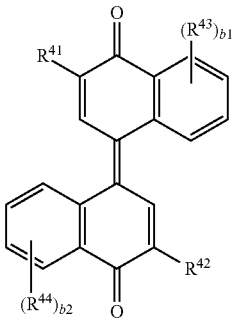

(5)

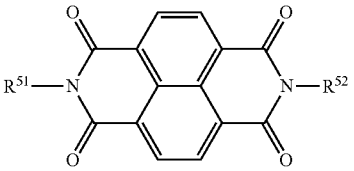

In general formula (1), $R^1$ represents: an alkyl group having a carbon number of at least 1 and no greater than 8 and having at least 1 halogen atom; a cycloalkyl group having a carbon number of at least 3 and no greater than 10 and having at least 1 halogen atom; an aryl group having a carbon number of at least 6 and no greater than 14, having at least 1 halogen atom, and optionally having an alkyl group having a carbon number of at least 1 and no greater than 6; a heterocyclic group having at least 1 halogen atom; or an aralkyl group having a carbon number of at least 7 and no greater than 20 and having at least 1 halogen atom. In general formula (2), $R^{21}$ and $R^{22}$ each represent, independently of one another, an alkyl group having a carbon number of at least 1 and no greater than 6. $R^{23}$ represents a halogen atom. In the general formula (3), $R^{31}$, $R^{32}$, $R^{33}$, $R^{34}$, $R^{35}$, and $R^{36}$ each represent, independently of one another: a halogen atom; a hydrogen atom; an alkyl group having a carbon number of at least 1 and no greater than 6 and optionally having at least 1 halogen atom; an alkenyl group having a carbon number of at least 2 and no greater than 6 and optionally having at least 1 halogen atom; an alkoxy group having a carbon number of at least 1 and no greater than 6 and optionally having at least 1 halogen atom; an aralkyl group having a carbon number of at least 7 and no greater than 20 and optionally having at least 1 halogen atom; an aryl group having a carbon number of at least 6 and no greater than 14 and optionally having at least 1 halogen atom; a heterocyclic group optionally having at least 1 halogen atom; a cyano group; a nitro group; a hydroxyl group; a carboxyl group; or an amino group. At the same time, at least one of $R^{31}$, $R^{32}$, $R^{33}$, $R^{34}$, $R^{35}$, and $R^{36}$ represents a halogen atom or a chemical group having at least 1 halogen atom. X represents an oxygen atom, a sulfur atom, or $=C(CN)_2$. Y represents an oxygen atom or a sulfur atom. In general formula (4), $R^{41}$ and $R^{42}$ each represent, independently of one another: an alkyl group having a carbon number of at least 1 and no greater than 8 and having at least 1 halogen atom; an aryl group having a carbon number of at least 6 and no greater than 14, having at least 1 halogen atom, and optionally having an alkyl group having a carbon number of at least 1 and no greater than 6; an aralkyl group having a carbon number of at least 7 and no greater than 20 and having at least 1 halogen atom; or a cycloalkyl group having a carbon number of at least 3 and no greater than 20 and having at least 1 halogen atom. $R^{43}$ and $R^{44}$ each represent, independently of one another, an alkyl group having a carbon number of at least 1 and no greater than 6, an aryl group having a carbon number of at least 6 and no greater than 14, a cycloalkyl group having a carbon number of at least 3 and no greater than 20, or a heterocyclic group. b1 and b2 each represent, independently of one another, an integer of at least 0 and no greater than 4. In general formula (5), $R^{51}$ and $R^{52}$ each represent, independently of one another: an aryl group having a carbon number of at least 6 and no greater than 14 and optionally having at least 1 halogen atom; an aryl group having a carbon number of at least 6 and no greater than 14, having at least 1 alkyl group having a carbon number of at least 1 and no greater than 6, and optionally having at least 1 halogen atom; an aryl group having a carbon number of at least 6 and no greater than 14, having at least 1 benzoyl group, and optionally having at least 1 halogen atom; an aralkyl group having a carbon number of at least 7 and no greater than 20 and optionally having at least 1 halogen atom; an alkyl group having a carbon number of at least 1 and no greater than 8 and optionally having at least 1 halogen atom; or a cycloalkyl group having a carbon number of at least 3 and no greater than 10 and optionally having at least 1 halogen atom. At the same time, at least one of $R^{51}$ and $R^{52}$ represents a chemical group having at least 1 halogen atom.

(20)

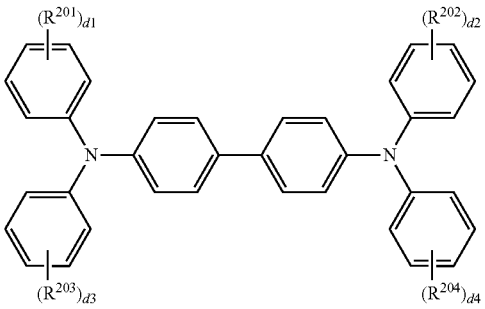

-continued (21)

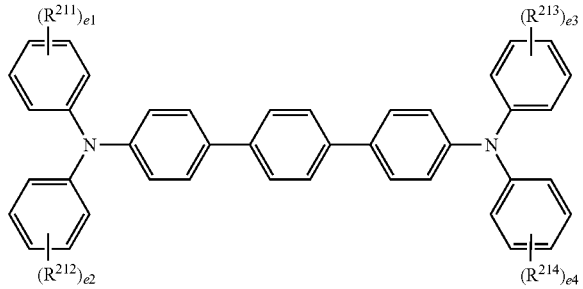

(22)

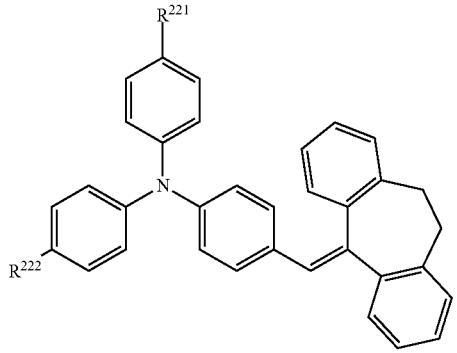

(23)

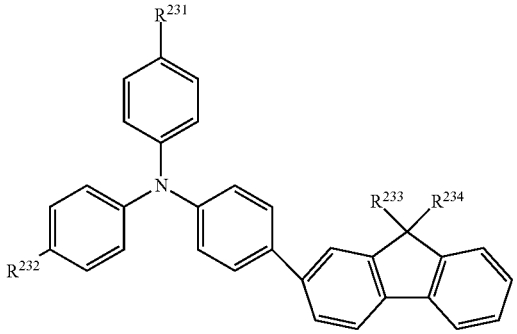

(24)

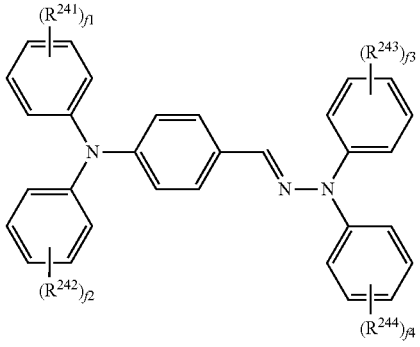

-continued (25)

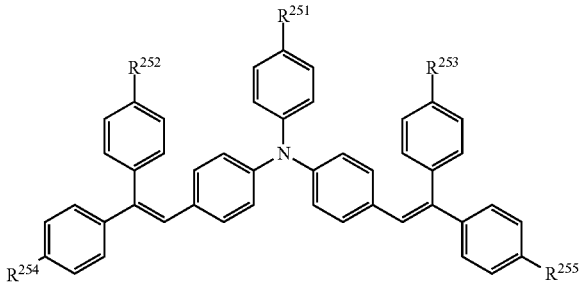

(26)

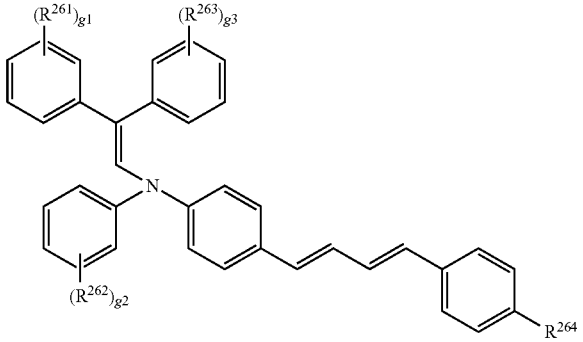

(27)

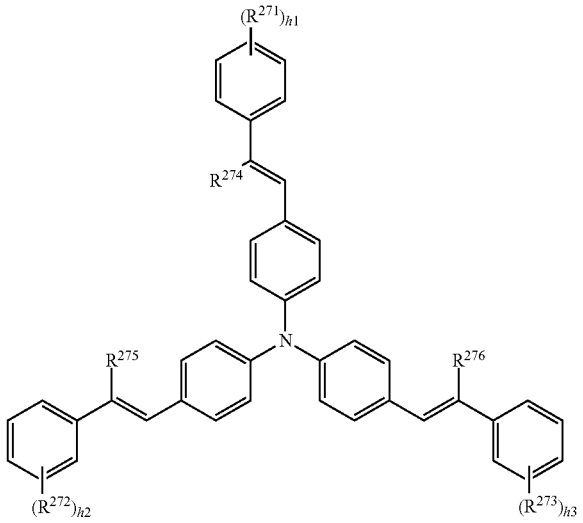

In general formula (20), $R^{201}$, $R^{202}$, $R^{203}$, and $R^{204}$ each represent, independently of one another, an alkyl group having a carbon number of at least 1 and no greater than 6. d1, d2, d3, and d4 each represent, independently of one another, an integer of at least 0 and no greater than 5. In general formula (21), $R^{211}$, $R^{212}$, $R^{213}$, and $R^{214}$ each represent, independently of one another, an alkyl group having a carbon number of at least 1 and no greater than 6. e1, e2, e3, and e4 each represent, independently of one another, an integer of at least 0 and no greater than 5. In general formula (22), $R^{221}$ and $R^{222}$ each represent, independently of one another, a hydrogen atom or an alkyl group having a carbon number of at least 1 and no greater than 6. In general formula (23), $R^{231}$, $R^{232}$, $R^{233}$, and $R^{234}$ each represent, independently of one another, a hydrogen atom or an alkyl group having a carbon number of at least 1 and no greater than 6. In general formula (24), $R^{241}$, $R^{242}$, $R^{243}$, and $R^{244}$ each represent, independently of one another, an alkyl group having a carbon number of at least 1 and no greater than 6. f1, f2, f3, and f4 each represent, independently of one another, an integer of at least 0 and no greater than 5. In general formula (25), $R^{251}$, $R^{252}$, $R^{253}$, $R^{254}$, and $R^{255}$ each represent, independently of one another, a hydrogen atom or an alkyl group having a carbon number of at least 1 and no greater than 6. In general formula (26), $R^{261}$, $R^{262}$, and $R^{263}$ each represent, independently of one another, an alkyl group having a carbon number of at least 1 and no greater than 6. g1, g2, and g3 each represent, independently of one another, an integer of at least 0 and no greater than 5. $R^{264}$ represents a hydrogen atom or an alkyl group having a carbon number of at least 1 and no greater than 6. In general formula (27), $R^{271}$, $R^{272}$, and $R^{273}$ each represent, independently of one another, an alkyl group having a carbon number of at least 1 and no greater than 6. h1, h2, and h3 each represent, independently of one another, an integer of at least 0 and no greater than 5. $R^{274}$, $R^{275}$, and $R^{276}$ each represent, independently of one another, a hydrogen atom or an aryl group having a carbon number of at least 6 and no greater than 14.

A process cartridge according to another aspect of the present disclosure includes the above-described electrophotographic photosensitive member.

An image forming apparatus according to another aspect of the present disclosure includes an image bearing member, a charger, a light exposure device, a developing device, and a transfer device. The charger charges a surface of the image bearing member. The light exposure device irradiates the charged surface of the image bearing member with light to form an electrostatic latent image on the surface of the image bearing member. The developing device develops the electrostatic latent image into a toner image. The transfer device transfers the toner image from the image bearing member onto a recording medium. The charger has a positive charging polarity. The transfer device transfers the toner image from the image bearing member onto the recording medium while the recording medium and the surface of the image bearing member are in contact with each other. The image bearing member is the above-described electrophotographic photosensitive member.

DETAILED DESCRIPTION

Figure 1A:
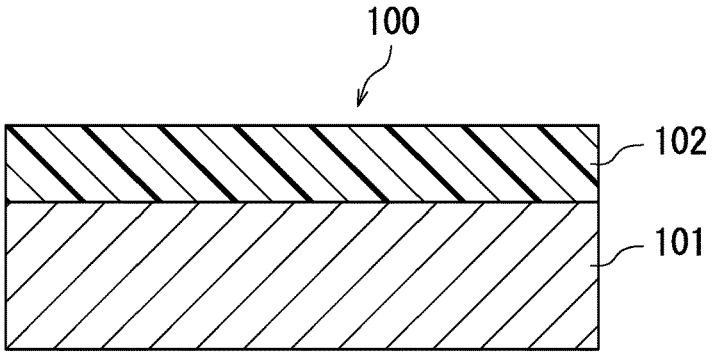
FIGS. 1A, 1B, and 1C are cross-sectional views each illustrating an example of an electrophotographic photosensitive member according to an embodiment of the present disclosure.

The following describes an embodiment of the present disclosure in detail. However, the present disclosure is by no means limited to the embodiment described below. The present disclosure may be practiced with alterations appropriately made within a scope of the object of the present disclosure. Note that although some overlapping explanations may be omitted as appropriate, such omission does not limit the gist of the present disclosure. In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. A chemical group "optionally having a chemical group" means the same as a chemical group "optionally substituted by a chemical group". A chemical group "having a chemical group" means the same as a chemical group "substituted by a chemical group". A chemical group "optionally having a halogen atom" means the same as a chemical group "optionally substituted by a halogen atom". A chemical group "having a halogen atom" means the same as a chemical group "substituted by a halogen atom".

In the following description, a halogen atom, an alkyl group having a carbon number of at least 1 and no greater than 8, an alkyl group having a carbon number of at least 1 and no greater than 6, an alkyl group having a carbon number of at least 1 and no greater than 4, an alkyl group having a carbon number of at least 1 and no greater than 3, an alkyl group having a carbon number of at least 3 and no greater than 5, an alkoxy group having a carbon number of at least 1 and no greater than 6, an aryl group having a carbon number of at least 6 and no greater than 14, an aryl group having a carbon number of at least 6 and no greater than 10, a cycloalkyl group having a carbon number of at least 3 and no greater than 20, a cycloalkyl group having a carbon number of at least 3 and no greater than 10, a heterocyclic group, an aralkyl group having a carbon number of at least 7 and no greater than 20, and an alkenyl group having a carbon number of at least 2 and no greater than 6 each refer to the following unless otherwise stated.

Examples of halogen atoms (halogen groups) include fluorine atom (fluoro group), chlorine atom (chloro group), bromine atom (bromo group), and iodine atom (iodine group).

The alkyl group having a carbon number of at least 1 and no greater than 8, the alkyl group having a carbon number of at least 1 and no greater than 6, the alkyl group having a carbon number of at least 1 and no greater than 4, the alkyl group having a carbon number of at least 1 and no greater than 3, and the alkyl group having a carbon number of at least 3 and no greater than 5 are each an unsubstituted straight or branched alkyl group. Examples of the alkyl group having a carbon number of at least 1 and no greater than 8 include methyl group, ethyl group, n-propyl group, isopropyl group, n-butyl group, sec-butyl group, tert-butyl group, n-pentyl group, isopentyl group, neopentyl group, 1,2-dimethylpropyl group, hexyl group, heptyl group, and octyl group. Examples of the alkyl group having a carbon number of at least 1 and no greater than 6 are the alkyl groups each having a carbon number of at least 1 and no greater than 6 among the examples of the alkyl group having a carbon number of at least 1 and no greater than 8. Examples of the alkyl group having a carbon number of at least 1 and no greater than 4 are the alkyl groups each having a carbon number of at least 1 and no greater than 4 among the examples of the alkyl group having a carbon number of at least 1 and no greater than 8. Examples of the alkyl group having a carbon number of at least 1 and no greater than 3 are the alkyl groups each having a carbon number of at least 1 and no greater than 3 among the examples of the alkyl group having a carbon number of at least 1 and no greater than 8. Examples of the alkyl group having a carbon number of at least 3 and no greater than 5 are the alkyl groups each having a carbon number of at least 3 and no greater than 5 among the examples of the alkyl group having a carbon number of at least 1 and no greater than 8.

The alkoxy group having a carbon number of at least 1 and no greater than 6 is an unsubstituted straight or branched alkoxy group. Examples of the alkoxy group having a carbon number of at least 1 and no greater than 6 include methoxy group, ethoxy group, n-propoxy group, isopropoxy group, n-butoxy group, sec-butoxy group, tert-butoxy group, n-pentoxy group, isopentoxy group, neopentoxy group, and hexyl group.

The aryl group having a carbon number of at least 6 and no greater than 14 and the aryl group having a carbon number of at least 6 and no greater than 10 are each an unsubstituted aryl group. Examples of the aryl group having a carbon number of at least 6 and no greater than 14 include phenyl group, naphthyl group, indacenyl group, biphenylenyl group, acenaphthylenyl group, anthryl group, and phenanthryl group. Examples of the aryl group having a carbon number of at least 6 and no greater than 10 include phenyl group and naphthyl group.

The cycloalkyl group having a carbon number of at least 3 and no greater than 20 and the cycloalkyl group having a carbon number of at least 3 and no greater than 10 are each an unsubstituted cycloalkyl group. Examples of the cycloalkyl group having a carbon number of at least 3 and no greater than 20 include cyclopropyl group, cyclobutyl group, cyclopentyl group, cyclohexyl group, cycloheptyl group, cyclooctyl group, cyclononyl group, cyclodecyl group, cycloundecyl group, cyclododecyl group, cyclotridecyl group, cyclotetradecyl group, cyclopentadecyl group, cyclohexadecyl group, cyclooctadecyl group, cyclononadecyl group, and cycloicosyl group. Examples of the cycloalkyl group having a carbon number of at least 3 and no greater than 10 are the cycloalkyl groups each having a carbon number of at least 3 and no greater than 10 among the examples of the cycloalkyl group having a carbon number of at least 3 and no greater than 20.

Examples of the heterocyclic group include heterocyclic groups having at least 5 and no greater than 14 ring members. Examples of the heterocyclic groups having at least 5 and no greater than 14 ring members include: heterocyclic group having a five- or six-member monocyclic ring including at least 1 and no greater than 3 hetero atoms other than carbon atoms; heterocyclic group resulting from condensation of two such heteromonocyclic rings; heterocyclic group resulting from condensation of such a heteromonocyclic ring and a five- or six-member monocyclic hydrocarbon ring; heterocyclic group resulting from condensation of three such heteromonocyclic rings; heterocyclic group resulting from condensation of two such heteromonocyclic rings and a five- or six-member monocyclic hydrocarbon ring; and heterocyclic group resulting from condensation of such a heteromonocyclic ring and two five- or six-member monocyclic hydrocarbon rings. The hetero atoms are at least one type of atom selected from the group consisting of nitrogen atom, sulfur atom, and oxygen atom. Specific examples of the heterocyclic group having at least 5 and no greater than 14 ring members include piperidinyl group, piperazinyl group, morpholinyl group, thiophenyl group, furanyl group, pyrrolyl group, imidazolyl group, pyrazolyl group, isothiazolyl group, isoxazolyl group, oxazolyl group, thiazolyl group, isothiazolyl group, furazanyl group, pyranyl group, pyridyl group, pyridazinyl group, pyrimidinyl group, pyrazinyl group, indolyl group, 1H-indazolyl group, isoindolyl group, chromenyl group, quinolinyl group, isoquinolinyl group, purinyl group, pteridinyl group, triazolyl group, tetrazolyl group, 4H-quinolizinyl group, naphthyridinyl group, benzofuranyl group, 1,3-benzodioxolyl group, benzoxazolyl group, benzothiazolyl group, benzimidazolyl group, carbazolyl group, phenanthridinyl group, acridinyl group, phenazinyl group, and phenanthrolinyl group.

The aralkyl group having a carbon number of at least 7 and no greater than 20 is an unsubstituted aralkyl group. Examples of the aralkyl group having a carbon number of at least 7 and no greater than 20 are alkyl groups each having a carbon number of at least 1 and no greater than 6 and having an aryl group having a carbon number of at least 6 and no greater than 14.

The alkenyl group having a carbon number of at least 2 and no greater than 6 is an unsubstituted straight or branched alkenyl group. The alkenyl group having a carbon number of at least 2 and no greater than 6 has at least one and no greater than three double bonds. Examples of the alkenyl group having a carbon number of at least 2 and no greater than 6 include ethenyl group, propenyl group, butenyl group, butadienyl group, pentenyl group, hexenyl group, hexadienyl group, and hexatrienyl group.

<Electrophotographic Photosensitive Member>

The present embodiment relates to an electrophotographic photosensitive member (hereinafter may be referred to as a photosensitive member). Use of the photosensitive member of the present embodiment can inhibit generation of white spots in an image being formed. Reasons for this are inferred as follows.

The photosensitive member of the present embodiment includes a photosensitive layer that contains any of compounds represented by general formulas (1), (2), (3), (4), and (5) shown below (hereinafter may be referred to as compounds (1), (2), (3), (4), and (5), respectively) as an electron transport material. The compounds (1) to (5) each have a halogen atom. The photosensitive layer further contains any of compounds represented by general formulas (20), (21), (22), (23), (24), (25), (26), and (27) described below (hereinafter may be referred to as compounds (20), (21), (22), (23), (24), (25), (26), and (27), respectively) as a hole transport material. As a result of the photosensitive layer containing such an electron transport material and such a hole transport material, it is possible to achieve a charge of calcium carbonate of at least +6.5 μC/g as measured by charging the calcium carbonate through friction with the photosensitive layer. Furthermore, as a result of the photosensitive layer containing such an electron transport material and such a hole transport material, it is possible to achieve a Vickers hardness of the photosensitive layer at 45° C. of at least 17.0 HV. In a situation in which the charge of calcium carbonate as measured by charging the calcium carbonate through friction with the photosensitive layer is at least +6.5 μC/g and the Vickers hardness of the photosensitive layer at 45° C. is at least 17.0 HV, generation of white spots can be effectively inhibited in an image being formed.

Figure 1B:
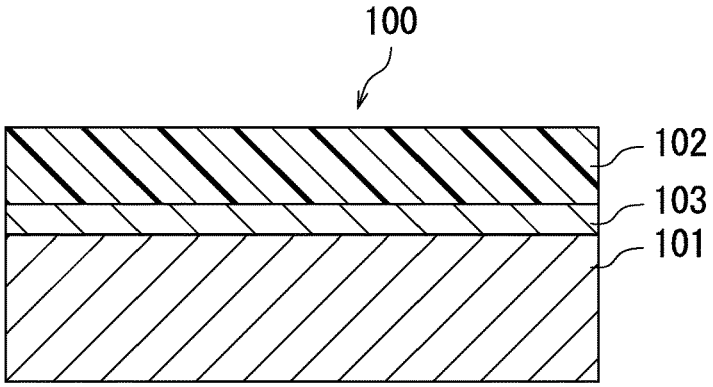
Figure 1C:
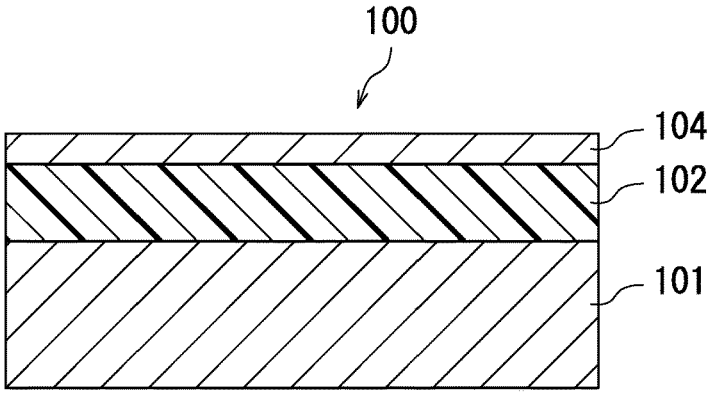

The following describes a structure of a photosensitive member 100 with reference to FIGS. 1A to 1C. FIGS. 1A to 1C are cross-sectional views each illustrating an example of the photosensitive member 100 of the present embodiment.

As illustrated in FIG. 1A, the photosensitive member 100 for example includes a conductive substrate 101 and a photosensitive layer 102. The photosensitive layer 102 has a single-layer structure. The photosensitive member 100 is a single-layer electrophotographic photosensitive member including the photosensitive layer 102 of the single-layer structure.

As illustrated in FIG. 1B, the photosensitive member 100 may include the conductive substrate 101, the photosensitive layer 102, and an intermediate layer 103 (an undercoat layer). The intermediate layer 103 is provided between the conductive substrate 101 and the photosensitive layer 102. The photosensitive layer 102 may be provided directly on the conductive substrate 101 as illustrated in FIG. 1A. Alternatively, the photosensitive layer 102 may be provided indirectly on the conductive substrate 101 with the intermediate layer 103 therebetween as illustrated in FIG. 1B.

As illustrated in FIG. 1C, the photosensitive member 100 may include the conductive substrate 101, the photosensitive layer 102, and a protective layer 104. The protective layer 104 is provided on the photosensitive layer 102.

No specific limitation is placed on the thickness of the photosensitive layer 102 as long as the photosensitive layer 102 is capable of sufficiently functioning as the photosensitive layer. The thickness of the photosensitive layer 102 is preferably at least 5 μm and no greater than 100 μm, and more preferably at least 10 μm and no greater than 50 μm.

In order to inhibit generation of white spots in an image being formed, it is preferable that the photosensitive layer 102 is a topmost layer of the photosensitive member 100.

Through the above, the structure of the photosensitive member 100 has been described with reference to FIGS. 1A to 1C. The following describes more details about the photosensitive member.

<Photosensitive Layer>

The photosensitive layer contains a charge generating material, an electron transport material, a polycarbonate resin, and a hole transport material. The photosensitive layer may contain an additive as necessary.

(Charge of Calcium Carbonate)

A charge (i.e. charge per mass) of calcium carbonate as measured by charging the calcium carbonate through friction with the photosensitive layer (hereinafter may be simply referred to as a charge of calcium carbonate) is at least +6.5 μC/g. Calcium carbonate is a major component of paper dust, which is an example of minute components of a recording medium.

In a situation in which the charge of calcium carbonate is smaller than +6.5 μC/g, an image being formed is likely to have white spots. Reasons for this are inferred as follows. In a situation in which the charge of calcium carbonate is smaller than +6.5 μC/g, minute components of the recording medium are not sufficiently positively charged through friction between the photosensitive member and the recording medium in contact with each other during image formation. Therefore, when a surface of the photosensitive member is positively charged in a charging process of image formation, minute components that are not sufficiently positively charged are electrically attracted to the surface of the photosensitive member. As a result, the minute components of the recording medium tend to adhere to the surface of the photosensitive member, resulting in generation of white spots in an image being formed.

In order to inhibit generation of white spots in an image being formed, the charge of calcium carbonate is preferably at least +7.5 μC/g, more preferably at least +7.8 μC/g, and still more preferably at least +8.0 μC/g. No specific limitation is placed on the upper limit of the charge of calcium carbonate as long as the photosensitive layer is capable of sufficiently functioning as the photosensitive layer of the photosensitive member. However, the upper limit is preferably +20.0 μC/g in terms of manufacturing costs.

Figure 2:
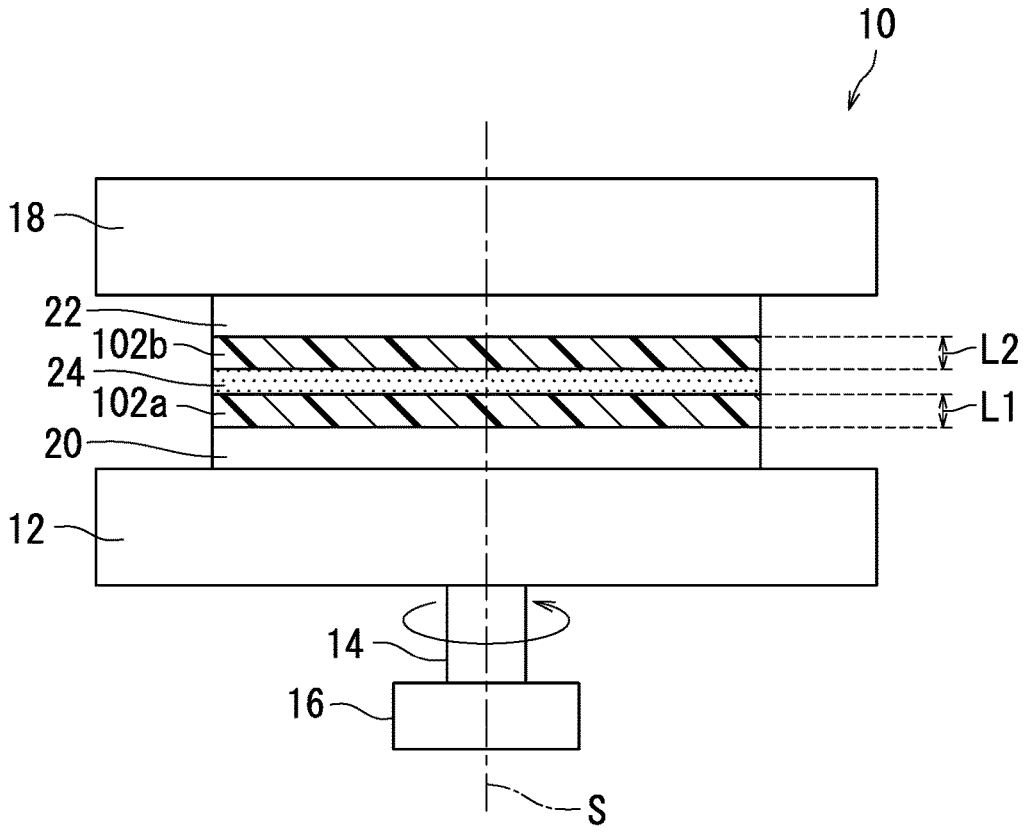
FIG. 2 is a diagram explaining a method for measuring a charge of calcium carbonate by charging the calcium carbonate through friction with a photosensitive layer.

The following describes with reference to FIG. 2 a method for measuring the charge of calcium carbonate by charging the calcium carbonate through friction with the photosensitive layer 102. The charge of calcium carbonate is measured by the first through fourth steps. In the first step, two photosensitive layers 102 are prepared. One of the two photosensitive layers 102 is a first photosensitive layer 102*a*. The other of the two photosensitive layers 102 is a second photosensitive layer 102*b*. The first photosensitive layer 102*a* and the second photosensitive layer 102*b* each have a circular shape of a diameter of 3 cm. In the second step, 0.007 g of calcium carbonate is applied over the first photosensitive layer 102*a*. Through the above, a calcium carbonate layer 24 is formed from calcium carbonate. Then, the second photosensitive layer 102*b* is overlaid onto the calcium carbonate layer 24. In the third step, the first photosensitive layer 102*a* is rotated at a rotational speed of 60 rpm for 60 seconds while keeping the second photosensitive layer 102*b* stationary in an environment at a temperature of 23° C. and a relative humidity of 50%. Thus, calcium carbonate contained in the calcium carbonate layer 24 is charged through friction with the first photosensitive layer 102*a* and the second photosensitive layer 102*b*. In the fourth step, the charged calcium carbonate is sucked using a charge measuring device. A total electric charge Q and a mass M of the sucked calcium carbonate are measured using the charge measuring device and a charge of calcium carbonate is calculated according to an expression Q/M. Note that the method for measuring the charge of calcium carbonate is more specifically described below in EXAMPLES. Through the above, the method for measuring the charge of calcium carbonate by charging the calcium carbonate through friction with the photosensitive layer 102 has been described with reference to FIG. 2.

The charge of calcium carbonate can be adjusted for example by changing the type of the electron transport material and the number and the type of halogen atoms in the electron transport material. The charge of calcium carbonate can be also adjusted for example by changing the combination of the type of the hole transport material and the type of the electron transport material.

(Vickers Hardness)

A Vickers hardness of the photosensitive layer at 45° C. is at least 17.0 HV. The Vickers hardness of the photosensitive layer at 45° C. is a Vickers hardness of the photosensitive layer measured when the temperature of the photosensitive layer is 45° C. In a situation in which the Vickers hardness of the photosensitive layer at 45° C. is less than 17.0 HV, white spots are generated in an image being formed. Reasons for this are inferred as follows. In a situation in which the Vickers hardness of the photosensitive layer at 45° C. is less than 17.0 HV, the photosensitive member in an image forming apparatus may have damage such as narrow scratches in the photosensitive layer upon contact with another member of the image forming apparatus. Minute components (for example, paper dust) of a recording medium may be caught by the narrow scratches. In such a situation, the minute components in the narrow scratches attract further minute components of the recording medium with a result that the attracted minute components adhere to the surface of the photosensitive member. As a result, white spots are generated in an image being formed.

In order to inhibit generation of white spots in an image being formed, the Vickers hardness of the photosensitive layer at 45° C. is preferably at least 18.5 HV, more preferably at least 19.5 HV, and still more preferably at least 20.0 HV. No specific limitation is placed on the upper limit of the Vickers hardness of the photosensitive layer at 45° C. as long as the photosensitive layer is capable of sufficiently functioning as the photosensitive layer of the photosensitive member. However, the upper limit is preferably 25.0 HV in terms of manufacturing costs.

The Vickers hardness of the photosensitive layer is measured by a method in accordance with Japanese Industrial Standard (JIS) Z2244. Note that the method for measuring the Vickers hardness of the photosensitive layer is more specifically described below in EXAMPLES.

The Vickers hardness of the photosensitive layer at 45° C. can for example be adjusted by changing the type of the hole transport material. The photosensitive layer containing a hole transport material having a structure that easily fills voids in the polycarbonate resin is expected to have high density and high Vickers hardness. Alternatively, the Vickers hardness of the photosensitive layer at 45° C. can for example be adjusted by changing the combination of the type of the hole transport material and the type of the electron transport material.

(Electron Transport Material)

The electron transport material includes the compound (1), (2), (3), (4), or (5). The compounds (1) to (5) each have a halogen atom. The halogen atom in the compounds (1) to (5) is preferably a fluorine atom or a chlorine atom, and more preferably a chlorine atom. The following describes the compounds (1) to (5).

[Compound (1)]

The compound (1) is represented by general formula (1) shown below.

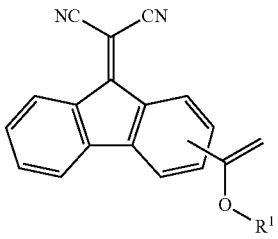

(1)

In general formula (1), $R^1$ represents: an alkyl group having a carbon number of at least 1 and no greater than 8 and having at least 1 halogen atom; a cycloalkyl group having a carbon number of at least 3 and no greater than 10 and having at least 1 halogen atom; an aryl group having a carbon number of at least 6 and no greater than 14, having at least 1 halogen atom, and optionally having an alkyl group having a carbon number of at least 1 and no greater than 6; a heterocyclic group having at least 1 halogen atom; or an aralkyl group having a carbon number of at least 7 and no greater than 20 and having at least 1 halogen atom.

In order to inhibit generation of white spots in an image being formed, $R^1$ in general formula (1) preferably represents an alkyl group having a carbon number of at least 1 and no greater than 8 and having at least 1 halogen atom.

The alkyl group having a carbon number of at least 1 and no greater than 8 that is represented by $R^1$ in general formula (1) is preferably an alkyl group having a carbon number of at least 1 and no greater than 6, more preferably an alkyl group having a carbon number of at least 3 and no greater than 5, and particularly preferably an n-butyl group. The alkyl group having a carbon number of at least 1 and no greater than 8 that is represented by $R^1$ has at least 1 halogen atom. The halogen atom of the alkyl group having a carbon number of at least 1 and no greater than 8 that is represented by $R^1$ is preferably a chlorine atom or a fluorine atom, and more preferably a chlorine atom. The alkyl group having a carbon number of at least 1 and no greater than 8 that is represented by $R^1$ preferably has 1 or 2 halogen atoms, and more preferably 1 halogen atom.

The compound (1) is preferably a compound represented by chemical formula (1-E1) (hereinafter may be referred to as a compound (1-E1)).

(1-E1)

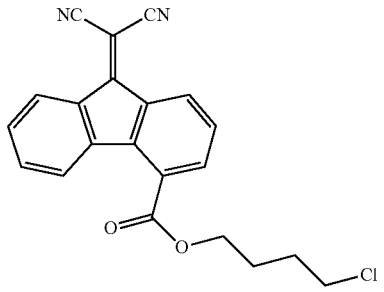

The compound (1) is for example prepared through reactions (r1-1) and (r1-2) shown below or through a method conforming therewith. The preparation may include an appropriate step as necessary in addition to these reactions. $R^1$ in a reaction formula including the reactions (r1-1) and (r1-2) is the same as defined for $R^1$ in general formula (1). Hereinafter, compounds represented by chemical formulas (1A) to (1D) may be respectively referred to as compounds (1A) to (1D).

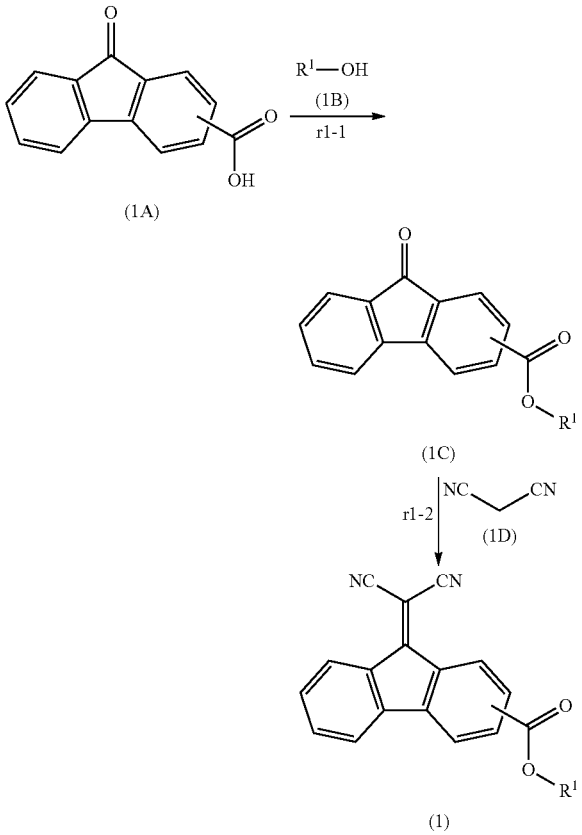

In the reaction (r1-1), 1 mole equivalent of the compound (1A) and 1 mole equivalent of the compound (1B) are caused to react to give 1 mole equivalent of the compound (1C). Preferably, the temperature of the reaction (r1-1) is at least 80° C. and no greater than 150° C. Preferably, the time of the reaction (r1-1) is at least 2 hours and no greater than 10 hours. The reaction (r1-1) may be promoted in the presence of a catalyst. Examples of catalysts that can be used include acid catalysts. Specific examples thereof include p-toluenesulfonic acid. The reaction (r1-1) may be performed in a solvent. Examples of solvents that can be used include toluene.

In the reaction (r1-2), 1 mole equivalent of the compound (1C) and 1 mole equivalent of the compound (1D, malononitrile) are caused to react to give 1 mole equivalent of the compound (1). Preferably, the temperature of the reaction (r1-2) is at least 40° C. and no greater than 120° C. Preferably, the time of the reaction (r1-2) is at least 1 hour and no greater than 10 hours. The reaction (r1-2) may be promoted in the presence of a catalyst. Examples of catalysts that can be used include base catalysts. Specific examples thereof include piperidine. The reaction (r1-2) may be performed in a solvent. Examples of solvents that can be used include polar solvents. Specific examples thereof include methanol.

[Compound (2)]

The compound (2) is represented by general formula (2) shown below.

(2)

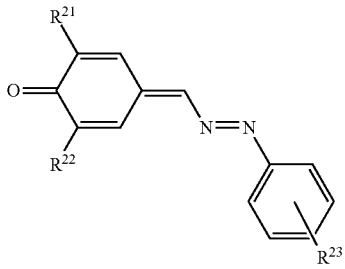

In general formula (2), $R^{21}$ and $R^{22}$ each represent, independently of one another, an alkyl group having a carbon number of at least 1 and no greater than 6. $R^{23}$ represents a halogen atom.

Preferably, in general formula (2), $R^{21}$ and $R^{22}$ each represent, independently of one another, an alkyl group having a carbon number of at least 1 and no greater than 4, and $R^{23}$ represents a halogen atom, in order to inhibit generation of white spots in an image being formed. Preferably, the alkyl group having a carbon number of at least 1 and no greater than 4 is a tert-butyl group. Preferably, the halogen atom is a chlorine atom.

The compound (2) is for example preferably a compound represented by chemical formula (2-E2) (hereinafter may be referred to as a compound (2-E2)). The compound (2) can be prepared by a method appropriately selected from known methods.

(2-E2)

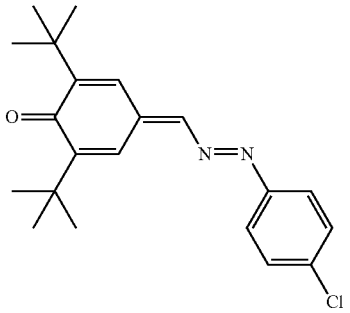

[Compound (3)]

The compound (3) is represented by general formula (3) shown below.

(3)

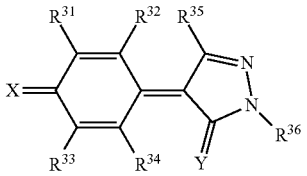

In general formula (3), $R^{31}$, $R^{32}$, $R^{33}$, $R^{34}$, $R^{35}$, and $R^{36}$ each represent, independently of one another, a halogen atom; a hydrogen atom; an alkyl group having a carbon number of at least 1 and no greater than 6 and optionally having at least 1 halogen atom; an alkenyl group having a carbon number of at least 2 and no greater than 6 and optionally having at least 1 halogen atom; an alkoxy group having a carbon number of at least 1 and no greater than 6 and optionally having at least 1 halogen atom; an aralkyl group having a carbon number of at least 7 and no greater than 20 and optionally having at least 1 halogen atom; an aryl group having a carbon number of at least 6 and no greater than 14 and optionally having at least 1 halogen atom; a heterocyclic group optionally having at least 1 halogen atom; a cyano group; a nitro group; a hydroxyl group; a carboxyl group; or an amino group. At the same time, at least one of $R^{31}$, $R^{32}$, $R^{33}$, $R^{34}$, $R^{35}$, and $R^{36}$ represents a halogen atom or a chemical group having at least 1 halogen atom. X represents an oxygen atom, a sulfur atom, or $=C(CN)_2$. Y represents an oxygen atom or a sulfur atom. The chemical group having at least 1 halogen atom is an alkyl group having a carbon number of at least 1 and no greater than 6 and having at least 1 halogen atom; an alkenyl group having a carbon number of at least 2 and no greater than 6 and having at least 1 halogen atom; an alkoxy group having a carbon number of at least 1 and no greater than 6 and having at least 1 halogen atom; an aralkyl group having a carbon number of at least 7 and no greater than 20 and having at least 1 halogen atom; an aryl group having a carbon number of at least 6 and no greater than 14 and having at least 1 halogen atom; or a heterocyclic group having at least 1 halogen atom.

Preferably, in general formula (3), $R^{31}$, $R^{32}$, $R^{33}$, $R^{34}$, $R^{35}$, and $R^{36}$ each represent, independently of one another, an aryl group having a carbon number of at least 6 and no greater than 14 and having at least 1 halogen atom or an alkyl group having a carbon number of at least 1 and no greater than 6, with the proviso that at least one of $R^{31}$, $R^{32}$, $R^{33}$, $R^{34}$, $R^{35}$, and $R^{36}$ represents an aryl group having a carbon number of at least 6 and no greater than 14 and having at least 1 halogen atom, X represents an oxygen atom, and Y represents an oxygen atom, in order to inhibit generation of white spots in an image being formed.

The aryl group having a carbon number of at least 6 and no greater than 14 that is represented by $R^{31}$, $R^{32}$, $R^{33}$, $R^{34}$, $R^{35}$, and $R^{36}$ is preferably an aryl group having a carbon number of at least 6 and no greater than 10, and more preferably a phenyl group. The aryl group having a carbon number of at least 6 and no greater than 14 that is represented by $R^{31}$, $R^{32}$, $R^{33}$, $R^{34}$, $R^{35}$, and $R^{36}$ optionally has at least 1 halogen atom. The halogen atom of the aryl group having a carbon number of at least 6 and no greater than 14 is preferably a fluorine atom or a chlorine atom, and more preferably a chlorine atom. The aryl group having a carbon number of at least 6 and no greater than 14 preferably has at least 1 and no greater than 3 halogen atoms, and more preferably 2 halogen atoms.

The alkyl group having a carbon number of at least 1 and no greater than 6 that is represented by $R^{31}$, $R^{32}$, $R^{33}$, $R^{34}$, $R^{35}$, and $R^{36}$ is preferably an alkyl group having a carbon number of at least 1 and no greater than 4, and more preferably a tert-butyl group or an isopropyl group.

At least one of $R^{31}$, $R^{32}$, $R^{33}$, $R^{34}$, $R^{35}$, and $R^{36}$ represents a chemical group having a halogen atom. Preferably, one or two of $R^{31}$, $R^{32}$, $R^{33}$, $R^{34}$, $R^{35}$, and $R^{36}$ represent a chemical group having a halogen atom. More preferably, one of $R^{31}$, $R^{32}$, $R^{33}$, $R^{34}$, $R^{35}$, and $R^{36}$ represents a chemical group having a halogen atom.

The compound (3) is preferably a compound represented by chemical formula (3-E3) (hereinafter may be referred to as a compound (3-E3)). The compound (3) can be prepared by a method appropriately selected from known methods.

(3-E3)

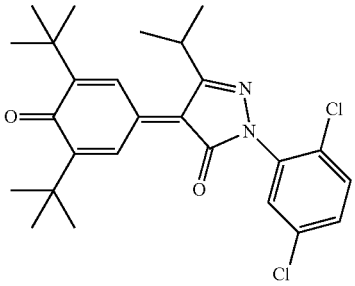

[Compound (4)]

The compound (4) is represented by general formula (4) shown below.

(4)

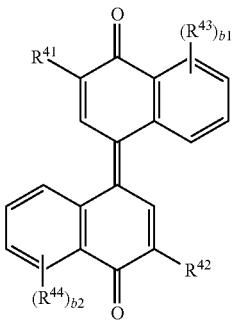

In general formula (4), $R^{41}$ and $R^{42}$ each represent, independently of one another, an alkyl group having a carbon number of at least 1 and no greater than 8 and having at least 1 halogen atom; an aryl group having a carbon number of at least 6 and no greater than 14, having at least 1 halogen atom, and optionally having an alkyl group having a carbon number of at least 1 and no greater than 6; an aralkyl group having a carbon number of at least 7 and no greater than 20 and having at least 1 halogen atom; or a cycloalkyl group having a carbon number of at least 3 and no greater than 20 and having at least 1 halogen atom. $R^{43}$ and $R^{44}$ each represent, independently of one another, an alkyl group having a carbon number of at least 1 and no greater than 6, an aryl group having a carbon number of at least 6 and no greater than 14, a cycloalkyl group having a carbon number of at least 3 and no greater than 20, or a heterocyclic group. b1 and b2 each represent, independently of one another, an integer of at least 0 and no greater than 4.

When b1 represents an integer of at least 2 and no greater than 4, chemical groups $R^{43}$ may be the same as or different from one another. When b2 represents an integer of at least 2 and no greater than 4, chemical groups $R^{44}$ may be the same as or different from one another.

Preferably, in general formula (4), $R^{41}$ and $R^{42}$ each represent, independently of one another, an alkyl group having a carbon number of at least 1 and no greater than 8 and having at least 1 halogen atom or an aralkyl group having a carbon number of at least 7 and no greater than 20 and having at least 1 halogen atom, and b1 and b2 each represent 0, in order to inhibit generation of white spots in an image being formed.

The alkyl group having a carbon number of at least 1 and no greater than 8 that is represented by $R^{41}$ and $R^{42}$ is preferably an alkyl group having a carbon number of at least 1 and no greater than 4, more preferably a butyl group, and still more preferably a tert-butyl group. The alkyl group having a carbon number of at least 1 and no greater than 8 has at least 1 halogen atom. The halogen atom of the alkyl group having a carbon number of at least 1 and no greater than 8 is preferably a chlorine atom or a fluorine atom, and more preferably a chlorine atom. The alkyl group having a carbon number of at least 1 and no greater than 8 preferably has at least 1 and no greater than 3 halogen atoms, and more preferably 1 halogen atom.

The aralkyl group having a carbon number of at least 7 and no greater than 20 that is represented by $R^{41}$ and $R^{42}$ is preferably an alkyl group having a carbon number of at least 1 and no greater than 6 and having an aryl group having a carbon number of at least 6 and no greater than 10, more preferably an alkyl group having a carbon number of at least 1 and no greater than 3 and having a phenyl group, and still more preferably a 1-phenylethyl group. The aralkyl group having a carbon number of at least 7 and no greater than 20 has at least 1 halogen atom. The halogen atom of the aralkyl group having a carbon number of at least 7 and no greater than 20 is preferably a chlorine atom or a fluorine atom, and more preferably a chlorine atom. The aralkyl group having a carbon number of at least 7 and no greater than 20 preferably has at least 1 and no greater than 3 halogen atoms, and more preferably 1 halogen atom. An aryl moiety of the aralkyl group having a carbon number of at least 7 and no greater than 20 may have a halogen atom, or an alkyl moiety thereof may have a halogen atom.

The compound (4) is preferably one of compounds represented by chemical formulas (4-E4) and (4-E5) (hereinafter may be referred to as compounds (4-E4) and (4-E5), respectively).

(4-E4)

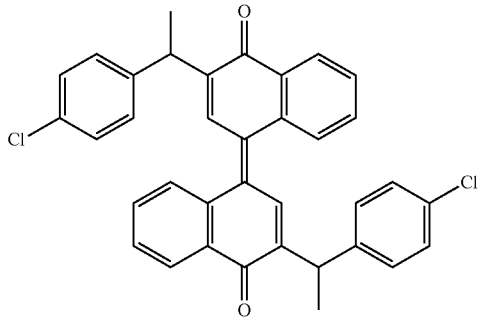

(4-E5)

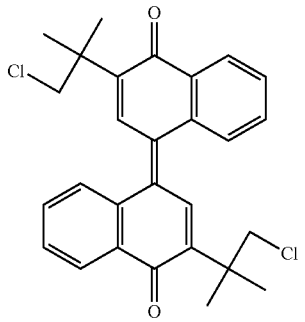

The compound (4) is for example prepared through reactions (r4-1) to (r4-3) shown below or through a method conforming therewith. The preparation may include an appropriate step as necessary in addition to these reactions. $R^{41}$, $R^{42}$, $R^{43}$, $R^{44}$, b1, and b2 in chemical formulas (4A) to (4F) shown in the reactions (r4-1) to (r4-3) are respectively the same as defined for $R^{41}$, $R^{42}$, $R^{43}$, $R^{44}$, b1, and b2 in general formula (4). Hereinafter, compounds represented by chemical formulas (4A) to (4F) may be referred to as compounds (4A) to (4F), respectively.

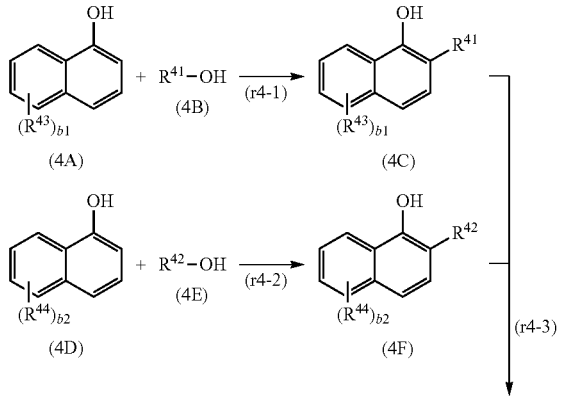

-continued

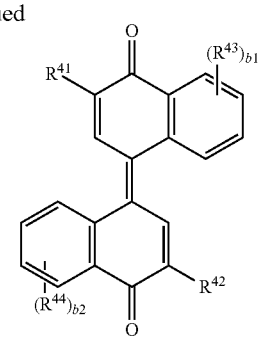

(4)

In the reaction (r4-1), 1 mole equivalent of the compound (4A) and 1 mole equivalent of the compound (4B) are caused to react in the presence of concentrated sulfuric acid to give 1 mole equivalent of the compound (4C). Preferably, the temperature of the reaction (r4-1) is room temperature (for example, 25° C.). Preferably, the time of the reaction (r4-1) is at least 1 hour and no greater than 10 hours. The reaction (r4-1) may be performed in a solvent. Examples of solvents that can be used include acetic acid.

The reaction (r4-2) can be performed in the same manner as the reaction (r4-1) except the following changes. That is, 1 mole equivalent of the compound (4A) is changed to 1 mole equivalent of the compound (4D). Furthermore, 1 mole equivalent of the compound (4B) is changed to 1 mole equivalent of the compound (4E). As a result, the reaction (r4-2) yields the compound (4F) instead of the compound (4C).

In the reaction (r4-3), 1 mole equivalent of the compound (4C) and 1 mole equivalent of the compound (4F) are caused to react in the presence of an oxidant to give the compound (4). Examples of oxidants that can be used include chloranil. Preferably, the temperature of the reaction (r4-3) is room temperature (for example, 25° C.). Preferably, the time of the reaction (r4-3) is at least 1 hour and no greater than 10 hours. Examples of solvents that can be used include chloroform.

[Compound (5)]

The compound (5) is represented by general formula (5) shown below.

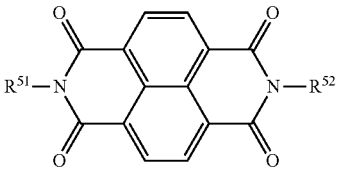

(5)

In general formula (5), $R^{51}$ and $R^{52}$ each represent, independently of one another, an aryl group having a carbon number of at least 6 and no greater than 14 and optionally having at least 1 halogen atom; an aryl group having a carbon number of at least 6 and no greater than 14, optionally having at least 1 halogen atom, and having at least 1 alkyl group having a carbon number of at least 1 and no greater than 6; an aryl group having a carbon number of at least 6 and no greater than 14, optionally having at least 1 halogen atom, and having at least 1 benzoyl group; an aralkyl group having a carbon number of at least 7 and no greater than 20 and optionally having at least 1 halogen atom; an alkyl group having a carbon number of at least 1 and no greater than 8 and optionally having at least 1 halogen atom; or a cycloalkyl group having a carbon number of at least 3 and no greater than 10 and optionally having at least 1 halogen atom. At least one of $R^{51}$ and $R^{52}$ represents a chemical group having at least 1 halogen atom. The chemical group having at least 1 halogen atom is an aryl group having a carbon number of at least 6 and no greater than 14 and having at least 1 halogen atom; an aryl group having a carbon number of at least 6 and no greater than 14, having at least 1 halogen atom, and having at least 1 alkyl group having a carbon number of at least 1 and no greater than 6; an aryl group having a carbon number of at least 6 and no greater than 14, having at least 1 halogen atom, and having at least 1 benzoyl group; an aralkyl group having a carbon number of at least 7 and no greater than 20 and having at least 1 halogen atom; an alkyl group having a carbon number of at least 1 and no greater than 8 and having at least 1 halogen atom; or a cycloalkyl group having a carbon number of at least 3 and no greater than 10 and having at least 1 halogen atom.

Preferably, in general formula (5), $R^{51}$ and $R^{52}$ each represent, independently of one another, an aryl group having a carbon number of at least 6 and no greater than 14, optionally having at least 1 halogen atom, and having at least 1 alkyl group having a carbon number of at least 1 and no greater than 6; or an aralkyl group having a carbon number of at least 7 and no greater than 20 and optionally having at least 1 halogen atom, with the proviso that at least one of $R^{51}$ and $R^{52}$ represents a chemical group having at least 1 halogen atom, in order to inhibit generation of white spots in an image being formed.

The following describes cases where $R^{51}$ and $R^{52}$ each represent an aryl group having a carbon number of at least 6 and no greater than 14, optionally having at least 1 halogen atom, and having at least 1 alkyl group having a carbon number of at least 1 and no greater than 6. The aryl group having a carbon number of at least 6 and no greater than 14 that is represented by $R^{51}$ and $R^{52}$ is preferably an aryl group having a carbon number of at least 6 and no greater than 10, and more preferably a phenyl group. The aryl group having a carbon number of at least 6 and no greater than 14 has at least 1 alkyl group having a carbon number of at least 1 and no greater than 6. The alkyl group having a carbon number of at least 1 and no greater than 6 of the aryl group having a carbon number of at least 6 and no greater than 14 is preferably an alkyl group having a carbon number of at least 1 and no greater than 3, and more preferably a methyl group or an ethyl group. The number of alkyl groups each having a carbon number of at least 1 and no greater than 6 of the aryl group having a carbon number of at least 6 and no greater than 14 is preferably at least 1 and no greater than 3, more preferably 1 or 2, and still more preferably 2. The aryl group having a carbon number of at least 6 and no greater than 14 may further have at least 1 halogen atom. The halogen atom of the aryl group having a carbon number of at least 6 and no greater than 14 is preferably a chlorine atom or a fluorine atom, and more preferably a chlorine atom. The aryl group having a carbon number of at least 6 and no greater than 14 preferably has at least 1 and no greater than 3 halogen atoms, more preferably 1 or 2 halogen atoms, and still more preferably 2 halogen atoms.

The following describes cases where $R^{51}$ and $R^{52}$ each represent an aralkyl group having a carbon number of at least 7 and no greater than 20 and optionally having at least 1 halogen atom. The aralkyl group having a carbon number of at least 7 and no greater than 20 that is represented by $R^{51}$ and $R^{52}$ is preferably an alkyl group having a carbon number of at least 1 and no greater than 6 and having an aryl group having a carbon number of at least 6 and no greater than 10, more preferably an alkyl group having a carbon number of at least 1 and no greater than 3 and having a phenyl group, and still more preferably a 1-phenylethyl group. The aralkyl group having a carbon number of at least 7 and no greater than 20 optionally has at least 1 halogen atom. The halogen atom of the aralkyl group having a carbon number of at least 7 and no greater than 20 is preferably a chlorine atom or a fluorine atom, and more preferably a chlorine atom. The aralkyl group having a carbon number of at least 7 and no greater than 20 preferably has at least 1 and no greater than 3 halogen atoms, more preferably 1 or 2 halogen atoms, and still more preferably 2 halogen atoms. An aryl moiety of the aralkyl group having a carbon number of at least 7 and no greater than 20 may have a halogen atom, or an alkyl moiety thereof may have a halogen atom.

At least one of $R^{51}$ and $R^{52}$ represents a chemical group having at least 1 halogen atom. Preferably, one of $R^{51}$ and $R^{52}$ represents a chemical group having at least 1 halogen atom and the other represents a chemical group having no halogen atom.

More preferably, in general formula (5), $R^{51}$ represents an aralkyl group having a carbon number of at least 7 and no greater than 20 and having at least 1 (preferably at least 1 and no greater than 3, and more preferably 1 or 2) halogen atom, and $R^{52}$ represents an aryl group having a carbon number of at least 6 and no greater than 14 and having at least 1 (preferably at least 1 and no greater than 3, and more preferably 1 or 2) alkyl group having a carbon number of at least 1 and no greater than 6, in order to inhibit generation of white spots in an image being formed.

The compound (5) is preferably a compound represented by chemical formula (5-E6) (hereinafter may be referred to as a compound (5-E6)).

(5-E6)

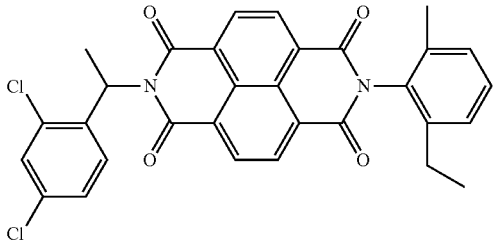

The compound (5) is for example prepared through reactions (r5-1) to (r5-3) shown below or through a method conforming therewith. The preparation may include an appropriate step as necessary in addition to these reactions. In chemical formulas (5A) to (5E) shown in the reactions (r5-1) to (r5-3), $R^{51}$ and $R^{52}$ are respectively the same as defined for $R^{51}$ and $R^{52}$ in general formula (5), and $R^{53}$ represents an alkyl group. Hereinafter, compounds represented by chemical formulas (5A) to (5E) may be referred to as compounds (5A) to (5E), respectively.

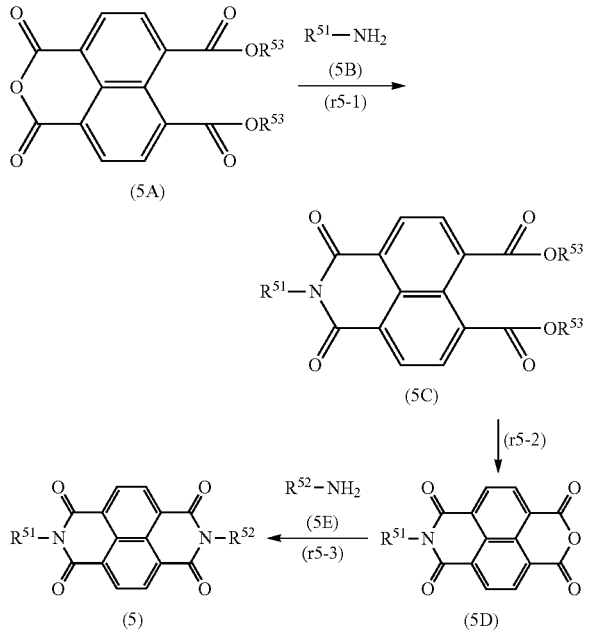

In the reaction (r5-1), 1 mole equivalent of the compound (5A) and 1 mole equivalent of the compound (5B) are caused to react in the presence of a base to give 1 mole equivalent of the compound (5C). Preferably, the temperature of the reaction (r5-1) is at least 80° C. and no greater than 150° C. Preferably, the time of the reaction (r5-1) is at least 1 hour and no greater than 8 hours. The reaction (r5-1) may be performed in a solvent. Examples of solvents that can be used include dioxane. In terms of increasing the yield of the compound (5C), the base preferably has low nucleophilicity. Examples of such bases include N,N-diisopropylethylamine (Hünig's base).

In the reaction (r5-2), 1 mole equivalent of the compound (5C) is caused to react in the presence of an acid to give 1 mole equivalent of the compound (5D). In the reaction (r5-2), a dicarboxylic acid is formed by hydrolysis of an ester of the compound (5C) in the presence of the acid, and a carboxylic anhydride is formed by cyclization of the dicarboxylic acid. As a result, the compound (5D) is formed. Preferably, the time of the reaction (r5-2) is at least 5 hours and no greater than 30 hours. Preferably, the temperature of the reaction (r5-2) is at least 70° C. and no greater than 150° C. Examples of preferable acids include trifluoroacetic acid. The acid may function as a solvent.

In the reaction (r5-3), 1 mole equivalent of the compound (5D) and 1 mole equivalent of the compound (5E) are caused to react in the presence of a base to give 1 mole equivalent of the compound (5). Preferably, the temperature of the reaction (r5-3) is at least 80° C. and no greater than 150° C. Preferably, the time of the reaction (r5-3) is at least 1 hour and no greater than 8 hours. The reaction (r5-3) may be performed in a solvent. Examples of solvents that can be used include dioxane. In terms of increasing the yield of the compound (5), the base preferably has low nucleophilicity. Examples of such bases include N,N-diisopropylethylamine (Hünig's base).

In a composition for effectively inhibiting generation of white spots in an image being formed, the electron transport material is preferably the compound (1), (4), or (5), and more preferably the compound (1-E1), (4-E4), (4-E5), or (5-E6).

In order to inhibit generation of white spots in an image being formed particularly effectively, the electron transport material is preferably the compound (4), and more preferably the compound (4-E4) or (4-E5) among the compounds (1), (4), and (5). In order to effectively inhibit generation of white spots in an image being formed, the electron transport material is preferably the compound (5), and more preferably the compound (5-E6) among the compounds (1), (4), and (5).

In order to particularly improve sensitivity characteristics of the photosensitive member while inhibiting generation of white spots in an image being formed, the electron transport material is preferably the compound (2), and more preferably the compound (2-E2).

The photosensitive layer may contain only one of the compounds (1), (2), (3), (4), and (5) as the electron transport material. Alternatively, the photosensitive layer may contain two or more of the compounds (1), (2), (3), (4), and (5) as the electron transport material. The photosensitive layer may further contain an electron transport material other than the compounds (1) to (5) (hereinafter may be referred to as an additional electron transport material) in addition to the compounds (1) to (5).

Examples of additional electron transport materials include quinone compounds, diimide-based compounds, hydrazone-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride that are not the compounds (1) to (5). Examples of quinone compounds that can be used include a diphenoquinone compound, an azoquinone compound, an anthraquinone compound, a naphthoquinone compound, a nitroanthraquinone compound, and a dinitroanthraquinone compound. One additional electron transport material may be used alone, or two or more additional electron transport materials may be used in combination.

Preferably, the amount of the electron transport material is at least 20 parts by mass and no greater than 40 parts by mass relative to 100 parts by mass of a binder resin contained in the photosensitive layer. In a situation in which the amount of the electron transport material is at least 20 parts by mass relative to 100 parts by mass of the binder resin, sensitivity characteristics of the photosensitive member can be easily improved. In a situation in which the amount of the electron transport material is no greater than 40 parts by mass relative to 100 parts by mass of the binder resin, the electron transport material readily dissolves in a solvent for photosensitive layer formation, and thus a uniform photosensitive layer is readily formed.

(Binder Resin)

The photosensitive layer contains a polycarbonate resin. The photosensitive layer contains the polycarbonate resin as the binder resin. Examples of polycarbonate resins that can be used include bisphenol ZC polycarbonate resin, bisphenol C polycarbonate resin, bisphenol A polycarbonate resin, and bisphenol Z polycarbonate resin. The bisphenol C polycarbonate resin is a polycarbonate resin having a repeating unit represented by chemical formula (10) shown below. Hereinafter, the polycarbonate resin having a repeating unit represented by chemical formula (10) may be referred to as a polycarbonate resin (10).

(10)

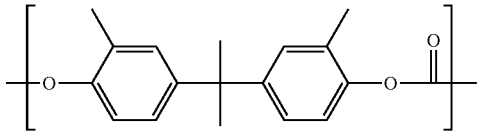

One polycarbonate resin may be used alone, or two or more polycarbonate resins may be used in combination. The photosensitive layer may contain only a polycarbonate resin as the binder resin. Alternatively, the photosensitive layer may further contain a binder resin other than the polycarbonate resin (hereinafter may be referred to as an additional binder resin) in addition to the polycarbonate resin. Examples of additional binder resins that can be used include thermoplastic resins that are not polycarbonate resins, thermosetting resins, and photocurable resins. Examples of thermoplastic resins that can be used include polyarylate resins, styrene-butadiene copolymers, styrene-acrylonitrile copolymers, styrene-maleic acid copolymers, acrylic acid polymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of thermosetting resins that can be used include silicone resins, epoxy resins, phenolic resins, urea resins, and melamine resins. Examples of photocurable resins that can be used include an acrylic acid adduct of an epoxy compound and an acrylic acid adduct of a urethane compound. One additional binder resin may be used alone, or two or more additional binder resins may be used in combination.

(Hole Transport Material)

The hole transport material includes a compound (20), (21), (22), (23), (24), (25), (26), or (27). The following describes the compounds (20) to (27).

[Compound (20)]

The compound (20) is represented by general formula (20) shown below.

(20)

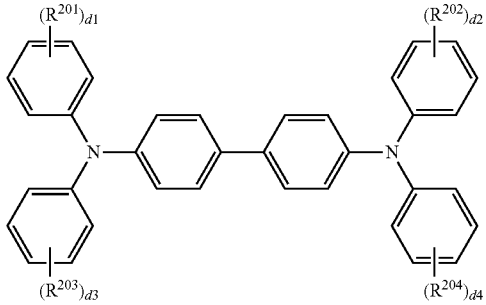

In general formula (20), $R^{201}$, $R^{202}$, $R^{203}$, and $R^{204}$ each represent, independently of one another, an alkyl group having a carbon number of at least 1 and no greater than 6. d1, d2, d3, and d4 each represent, independently of one another, an integer of at least 0 and no greater than 5.

When d1 represents an integer of at least 2 and no greater than 5, chemical groups $R^{201}$ may be the same as or different from one another. When d2 represents an integer of at least 2 and no greater than 5, chemical groups $R^{202}$ may be the same as or different from one another. When d3 represents an integer of at least 2 and no greater than 5, chemical groups $R^{203}$ may be the same as or different from one another. When d4 represents an integer of at least 2 and no greater than 5, chemical groups $R^{204}$ may be the same as or different from one another.

The alkyl group having a carbon number of at least 1 and no greater than 6 that is represented by $R^{201}$, $R^{202}$, $R^{203}$, and $R^{204}$ is preferably an alkyl group having a carbon number of at least 1 and no greater than 3, and more preferably a methyl group. Preferably, d1, d2, d3, and d4 each represent, independently of one another, 0 or 1. More preferably, d1 and d2 each represent 1, and d3 and d4 each represent 0.

Preferable examples of the compound (20) include a compound represented by chemical formula (20-H1) shown below (hereinafter may be referred to as a compound (20-H1)).

(20-H1)

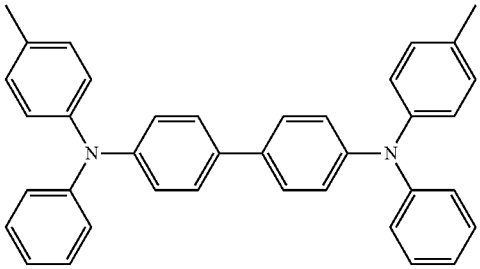

[Compound (21)]

The compound (21) is represented by general formula (21) shown below.

(21)

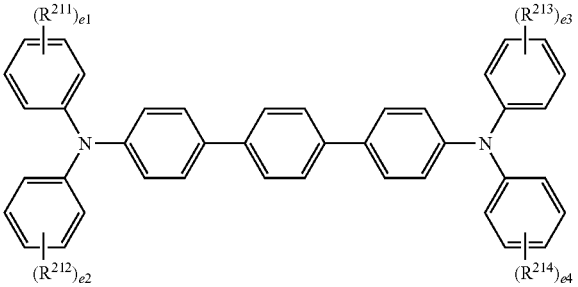

In general formula (21), $R^{211}$, $R^{212}$, $R^{213}$, and $R^{214}$ each represent, independently of one another, an alkyl group having a carbon number of at least 1 and no greater than 6. e1, e2, e3, and e4 each represent, independently of one another, an integer of at least 0 and no greater than 5.

When e1 represents an integer of at least 2 and no greater than 5, chemical groups $R^{211}$ may be the same as or different from one another. When e2 represents an integer of at least 2 and no greater than 5, chemical groups $R^{212}$ may be the same as or different from one another. When e3 represents an integer of at least 2 and no greater than 5, chemical groups $R^{213}$ may be the same as or different from one another. When e4 represents an integer of at least 2 and no greater than 5, chemical groups $R^{214}$ may be the same as or different from one another.

The alkyl group having a carbon number of at least 1 and no greater than 6 that is represented by $R^{211}$, $R^{212}$, $R^{213}$, and $R^{214}$ is preferably an alkyl group having a carbon number of at least 1 and no greater than 3, and more preferably a methyl group. Preferably, e1, e2, e3, and e4 each represent, independently of one another, 0 or 1. More preferably, e1 and e3 each represent 1, and e2 and e4 each represent 0.

Preferable examples of the compound (21) include a compound represented by chemical formula (21-H2) shown below (hereinafter may be referred to as a compound (21-H2)).

(21-H2)

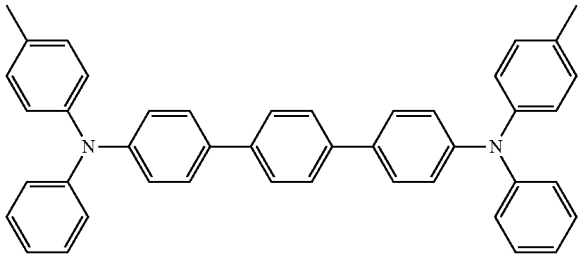

[Compound (22)]

The compound (22) is represented by general formula (22) shown below.

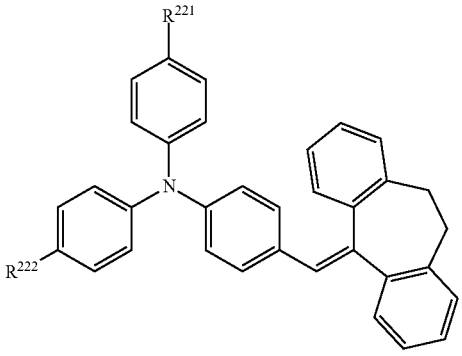

In general formula (22), $R^{221}$ and $R^{222}$ each represent, independently of one another, a hydrogen atom or an alkyl group having a carbon number of at least 1 and no greater than 6.

$R^{221}$ and $R^{222}$ preferably each represent, independently of one another, an alkyl group having a carbon number of at least 1 and no greater than 6, and more preferably an alkyl group having a carbon number of at least 1 and no greater than 3. Still more preferably, $R^{221}$ and $R^{222}$ each represent a methyl group.

Preferable examples of the compound (22) include a compound represented by chemical formula (22-H3) shown below (hereinafter may be referred to as a compound (22-H3)).

(22-H3)

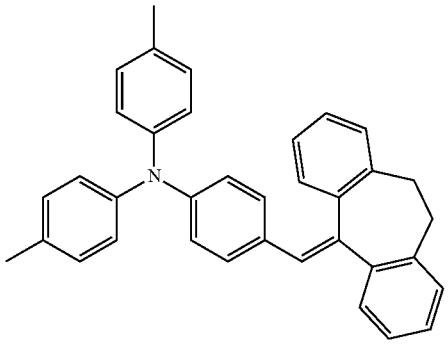

[Compound (23)]

The compound (23) is represented by general formula (23) shown below.

(23)

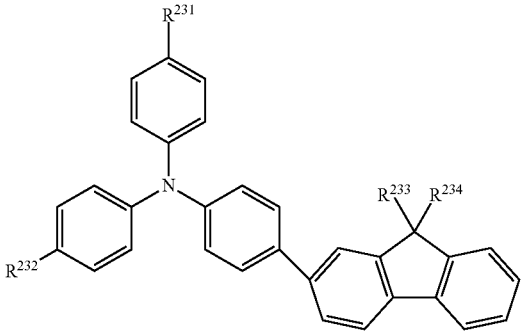

In general formula (23), $R^{231}$, $R^{232}$, $R^{233}$, and $R^{234}$ each represent, independently of one another, a hydrogen atom or an alkyl group having a carbon number of at least 1 and no greater than 6.

$R^{231}$, $R^{232}$, $R^{233}$, and $R^{234}$ preferably each represent, independently of one another, an alkyl group having a carbon number of at least 1 and no greater than 6, and more preferably an alkyl group having a carbon number of at least 1 and no greater than 3. Still more preferably, $R^{231}$, $R^{232}$, $R^{233}$, and $R^{234}$ each represent a methyl group.

Preferable examples of the compound (23) include a compound represented by chemical formula (23-H4) shown below (hereinafter may be referred to as a compound (23-H4)).

(23-H4)

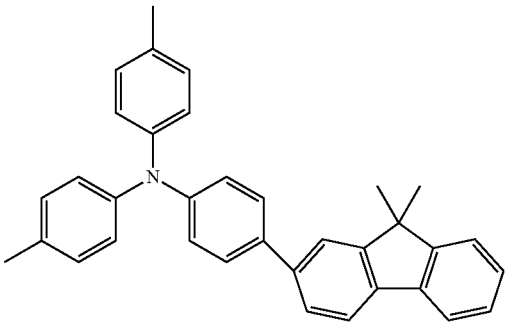

[Compound (24)]

The compound (24) is represented by general formula (24) shown below.

(24)

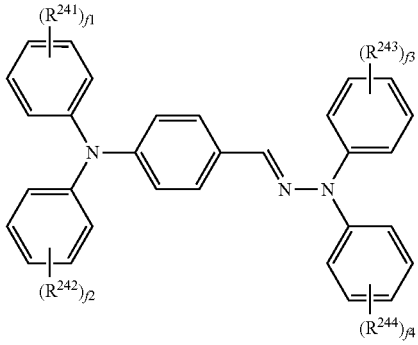

In general formula (24), $R^{241}$, $R^{242}$, $R^{243}$, and $R^{244}$ each represent, independently of one another, an alkyl group having a carbon number of at least 1 and no greater than 6. f1, f2, f3, and f4 each represent, independently of one another, an integer of at least 0 and no greater than 5.

When f1 represents an integer of at least 2 and no greater than 5, chemical groups $R^{241}$ may be the same as or different from one another. When f2 represents an integer of at least 2 and no greater than 5, chemical groups $R^{242}$ may be the same as or different from one another. When f3 represents an integer of at least 2 and no greater than 5, chemical groups $R^{243}$ may be the same as or different from one another. When f4 represents an integer of at least 2 and no greater than 5, chemical groups $R^{244}$ may be the same as or different from one another.

The alkyl group having a carbon number of at least 1 and no greater than 6 that is represented by $R^{241}$, $R^{242}$, $R^{243}$, and $R^{244}$ is preferably an alkyl group having a carbon number of at least 1 and no greater than 3, and more preferably a methyl group. Preferably, f1, f2, f3, and f4 each represent, independently of one another, 0 or 1. More preferably, f1 and f2 each represent 1, and f3 and f4 each represent 0.

Preferable examples of the compound (24) include a compound represented by chemical formula (24-H5) shown below (hereinafter may be referred to as a compound (24-H5)).

(24-H5)

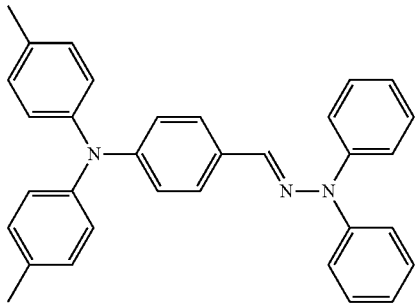

[Compound (25)]

The compound (25) is represented by general formula (25) shown below.

(25)

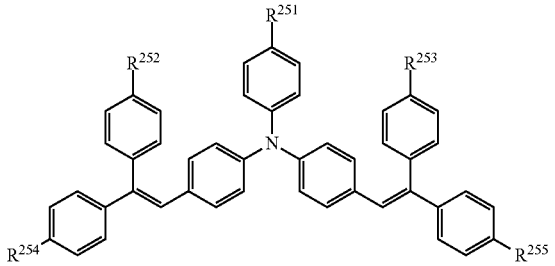

In general formula (23), $R^{251}$, $R^{252}$, $R^{253}$, $R^{254}$, and $R^{255}$ each represent, independently of one another, a hydrogen atom or an alkyl group having a carbon number of at least 1 and no greater than 6.

The alkyl group having a carbon number of at least 1 and no greater than 6 that is represented by $R^{251}$, $R^{252}$, $R^{253}$, $R^{254}$, and $R^{255}$ is preferably an alkyl group having a carbon number of at least 1 and no greater than 3, and more preferably a methyl group.

Preferable examples of the compound (25) include a compound represented by chemical formula (25-H6) shown below (hereinafter may be referred to as a compound (25-H6)).

(25-H6)

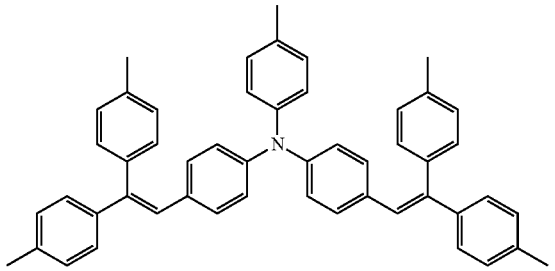

[Compound (26)]

The compound (26) is represented by general formula (26) shown below.

(26)

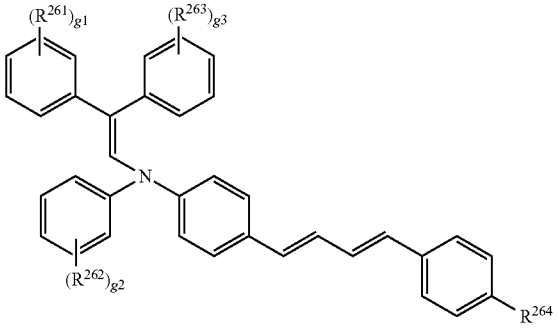

In general formula (26), $R^{261}$, $R^{262}$, and $R^{263}$ each represent, independently of one another, an alkyl group having a carbon number of at least 1 and no greater than 6. g1, g2, and g3 each represent, independently of one another, an integer of at least 0 and no greater than 5. $R^{264}$ represents a hydrogen atom or an alkyl group having a carbon number of at least 1 and no greater than 6.

When g1 represents an integer of at least 2 and no greater than 5, chemical groups $R^{261}$ may be the same as or different from one another. When g2 represents an integer of at least 2 and no greater than 5, chemical groups $R^{262}$ may be the same as or different from one another. When g3 represents an integer of at least 2 and no greater than 5, chemical groups $R^{263}$ may be the same as or different from one another.

The alkyl group having a carbon number of at least 1 and no greater than 6 that is represented by $R^{261}$, $R^{262}$, $R^{263}$, and $R^{264}$ is preferably an alkyl group having a carbon number of at least 1 and no greater than 3, and more preferably a methyl group. g1, g2, and g3 each preferably represent 1 or 0, and more preferably 0. $R^{264}$ preferably represents a hydrogen atom.

Preferable examples of the compound (26) include a compound represented by chemical formula (26-H7) shown below (hereinafter may be referred to as a compound (26-H7)).

(26-H7)

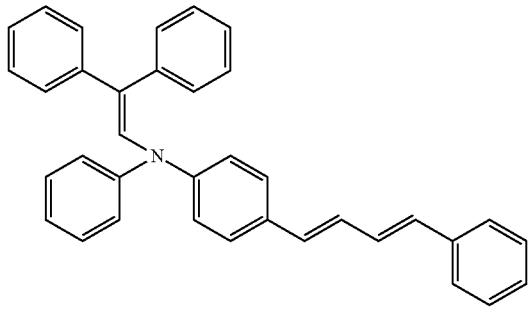

[Compound (27)]

The compound (27) is represented by general formula (27) shown below.

(27)

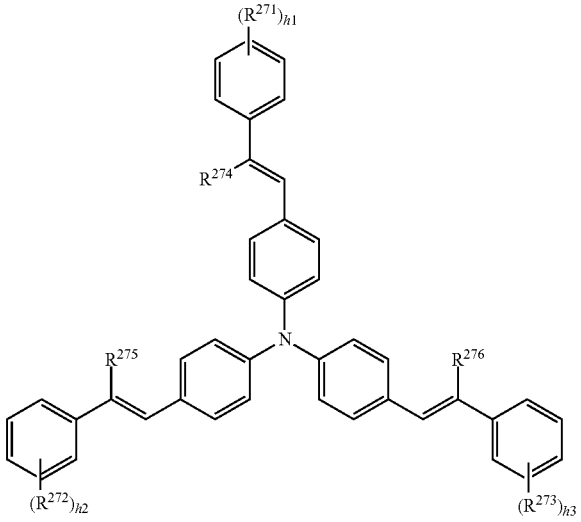

In general formula (27), $R^{271}$, $R^{272}$, and $R^{273}$ each represent, independently of one another, an alkyl group having a carbon number of at least 1 and no greater than 6. h1, h2, and h3 each represent, independently of one another, an integer of at least 0 and no greater than 5. $R^{274}$, $R^{275}$, and $R^{276}$ each represent, independently of one another, a hydrogen atom or an aryl group having a carbon number of at least 6 and no greater than 14.

When h1 represents an integer of at least 2 and no greater than 5, chemical groups $R^{271}$ may be the same as or different from one another. When h2 represents an integer of at least 2 and no greater than 5, chemical groups $R^{272}$ may be the same as or different from one another. When h3 represents an integer of at least 2 and no greater than 5, chemical groups $R^{273}$ may be the same as or different from one another.

The alkyl group having a carbon number of at least 1 and no greater than 6 that is represented by $R^{271}$, $R^{272}$, and $R^{273}$ is preferably an alkyl group having a carbon number of at least 1 and no greater than 3, and more preferably a methyl group. Preferably, h1, h2, and h3 each represent, independently of one another, 0 or 1. The aryl group having a carbon number of at least 6 and no greater than 14 that is represented by $R^{274}$, $R^{275}$, and $R^{276}$ is preferably an aryl group having a carbon number of at least 6 and no greater than 10, and more preferably a phenyl group.

Preferable examples of the compound (27) include compounds represented by chemical formulas (27-H8) and (27-H9) shown below (hereinafter may be referred to as compounds (27-H8) and (27-H9), respectively).

(27-H8)

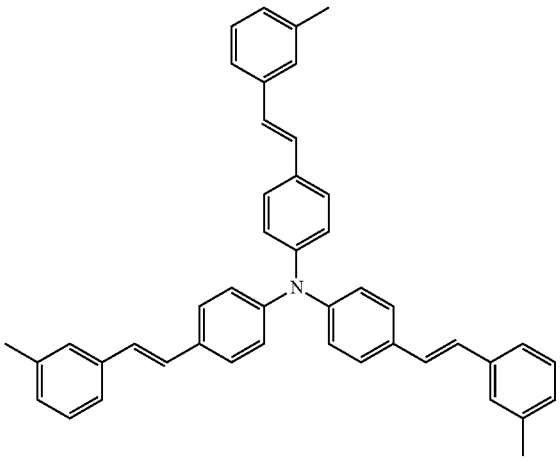

(27-H9)

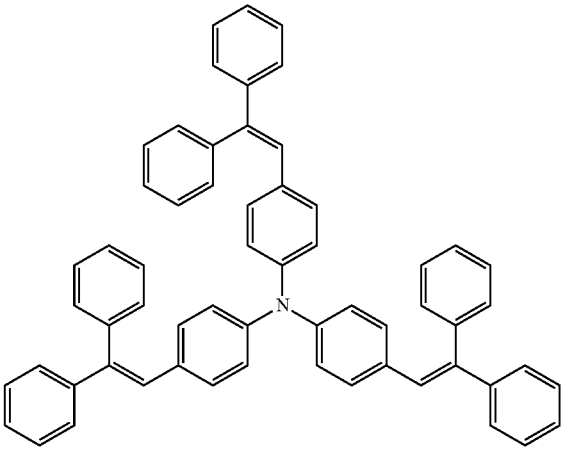

In order to inhibit generation of white spots in an image being formed, the hole transport material is preferably the compound (20), (22), (23), (25), or (27), and more preferably the compound (20-H1), (22-H3), (23-H4), (25-H6), or (27-H8).

In order to particularly improve sensitivity characteristics of the photosensitive member while inhibiting generation of white spots in an image being formed, the hole transport material is preferably the compound (27), and more preferably the compound (27-H9).

The photosensitive layer may contain only one of the compounds (20), (21), (22), (23), (24), (25), (26), and (27) as the hole transport material. Alternatively, the photosensitive layer may contain two or more of the compounds (20), (21), (22), (23), (24), (25), (26), and (27) as the hole transport material. Furthermore, the photosensitive layer may further contain a hole transport material other than the compounds (20) to (27) (hereinafter may be referred to as an additional hole transport material) in addition to the compounds (20) to (27).

Examples of additional hole transport materials that can be used include triphenylamine derivatives, diamine derivatives (specific examples include N,N,N',N'-tetraphenylbenzidine derivatives, N,N,N',N'-tetraphenylphenylenediamine derivatives, N,N,N',N'-tetraphenylnaphthylenediamine derivatives, N,N,N',N'-tetraphenylphenanthrylenediamine derivatives, and di(aminophenylethenyl)benzene derivatives), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds that are not the compounds (20) to (27). One additional hole transport material may be used alone, or two or more additional hole transport materials may be used in combination.

The amount of the hole transport material contained in the photosensitive layer is preferably at least 10 parts by mass and no greater than 200 parts by mass relative to 100 parts by mass of the binder resin, and more preferably at least 10 parts by mass and no greater than 100 parts by mass.

(Combination of Materials)

In order to inhibit generation of white spots in an image being formed, the following combinations of an electron transport material and a hole transport material are preferable. For the same reason as above, it is more preferable to employ any of the following combinations of an electron transport material and a hole transport material and use the polycarbonate resin (10) as a binder resin. For the same reason as above, it is still more preferable to employ any of the following combinations of an electron transport material and a hole transport material, use the polycarbonate resin (10) as a binder resin, and use X-form metal-free phthalocyanine as a charge generating material. The X-form metal-free phthalocyanine will be described below.

The preferable combinations are those in which:

the electron transport material is the compound (2) and the hole transport material is the compound (20);

the electron transport material is the compound (2) and the hole transport material is the compound (21);

the electron transport material is the compound (2) and the hole transport material is the compound (22);

the electron transport material is the compound (2) and the hole transport material is the compound (23);

the electron transport material is the compound (2) and the hole transport material is the compound (24);

the electron transport material is the compound (2) and the hole transport material is the compound (25);

the electron transport material is the compound (2) and the hole transport material is the compound (26);

the electron transport material is the compound (2) and the hole transport material is the compound (27);

the electron transport material is the compound (1) and the hole transport material is the compound (25);

the electron transport material is the compound (3) and the hole transport material is the compound (25);

the electron transport material is the compound (4) and the hole transport material is the compound (25);

the electron transport material is the compound (1) and the hole transport material is the compound (20);

the electron transport material is the compound (3) and the hole transport material is the compound (20);

the electron transport material is the compound (4) and the hole transport material is the compound (20);

the electron transport material is the compound (5) and the hole transport material is the compound (20); or the electron transport material is the compound (5) and the hole transport material is the compound (21).

In order to inhibit generation of white spots in an image being formed, the following combinations of an electron transport material and a hole transport material are preferable. For the same reason as above, it is more preferable to employ any of the following combinations of an electron transport material and a hole transport material and use the polycarbonate resin (10) as a binder resin. For the same reason as above, it is still more preferable to employ any of the following combinations of an electron transport material and a hole transport material, use the polycarbonate resin (10) as a binder resin, and use X-form metal-free phthalocyanine as a charge generating material.

The preferable combinations are those in which:

the electron transport material is the compound (2-E2) and the hole transport material is the compound (20-H1);

the electron transport material is the compound (2-E2) and the hole transport material is the compound (21-H2);

the electron transport material is the compound (2-E2) and the hole transport material is the compound (22-H3);

the electron transport material is the compound (2-E2) and the hole transport material is the compound (23-H4);

the electron transport material is the compound (2-E2) and the hole transport material is the compound (24-H5);

the electron transport material is the compound (2-E2) and the hole transport material is the compound (25-H6);

the electron transport material is the compound (2-E2) and the hole transport material is the compound (26-H7);

the electron transport material is the compound (2-E2) and the hole transport material is the compound (27-H8);

the electron transport material is the compound (2-E2) and the hole transport material is the compound (27-H9);

the electron transport material is the compound (1-E1) and the hole transport material is the compound (25-H6);

the electron transport material is the compound (3-E3) and the hole transport material is the compound (25-H6);

the electron transport material is the compound (4-E4) and the hole transport material is the compound (25-H6);

the electron transport material is the compound (1-E1) and the hole transport material is the compound (20-H1);

the electron transport material is the compound (3-E3) and the hole transport material is the compound (20-H1);

the electron transport material is the compound (4-E4) and the hole transport material is the compound (20-H1);

the electron transport material is the compound (4-E5) and the hole transport material is the compound (20-H1);

the electron transport material is the compound (5-E6) and the hole transport material is the compound (20-H1); or the electron transport material is the compound (5-E6) and the hole transport material is the compound (21-H2).

In order to inhibit generation of white spots in an image being formed more effectively, the following combinations of an electron transport material and a hole transport material are preferable. For the same reason as above, it is more preferable to employ any of the following combinations of an electron transport material and a hole transport material and use the polycarbonate resin (10) as a binder resin. For the same reason as above, it is still more preferable to employ any of the following combinations of an electron transport material and a hole transport material, use the polycarbonate resin (10) as a binder resin, and use X-form metal-free phthalocyanine as a charge generating material.

The preferable combinations are those in which:

the electron transport material is the compound (1) and the hole transport material is the compound (25);

the electron transport material is the compound (4) and the hole transport material is the compound (25);

the electron transport material is the compound (1) and the hole transport material is the compound (20);

the electron transport material is the compound (4) and the hole transport material is the compound (20);

the electron transport material is the compound (5) and the hole transport material is the compound (20); or the electron transport material is the compound (5) and the hole transport material is the compound (21-H2).

In order to inhibit generation of white spots in an image being formed more effectively, the following combinations of an electron transport material and a hole transport material are preferable. For the same reason as above, it is more preferable to employ any of the following combinations of an electron transport material and a hole transport material and use the polycarbonate resin (10) as a binder resin. For the same reason as above, it is still more preferable to employ any of the following combinations of an electron transport material and a hole transport material, use the polycarbonate resin (10) as a binder resin, and use X-form metal-free phthalocyanine as a charge generating material.

The preferable combinations are those in which:

the electron transport material is the compound (1-E1) and the hole transport material is the compound (25-H6);

the electron transport material is the compound (4-E4) and the hole transport material is the compound (25-H6);

the electron transport material is the compound (1-E1) and the hole transport material is the compound (20-H1);

the electron transport material is the compound (4-E4) and the hole transport material is the compound (20-H1);

the electron transport material is the compound (4-E5) and the hole transport material is the compound (20-H1);

the electron transport material is the compound (5-E6) and the hole transport material is the compound (20-H1); or the electron transport material is the compound (5-E6) and the hole transport material is the compound (21-H2).

In order to inhibit generation of white spots in an image being formed particularly effectively, it is preferable that the electron transport material is the compound (4) and the hole transport material is the compound (25). It is more preferable that the electron transport material is the compound (4), the hole transport material is the compound (25), and the binder resin is the polycarbonate resin (10). For the same reason as above, it is preferable that the electron transport material is the compound (4-E4) and the hole transport material is the compound (25-H6). It is more preferable that the electron transport material is the compound (4-E4), the hole transport material is the compound (25-H6), and the binder resin is the polycarbonate resin (10).

In order to inhibit generation of white spots in an image being formed particularly effectively, it is also preferable that the electron transport material is the compound (4) and the hole transport material is the compound (20). It is also more preferable that the electron transport material is the compound (4), the hole transport material is the compound (20), and the binder resin is the polycarbonate resin (10). For the same reason as above, it is also preferable that the electron transport material is the compound (4-E4) and the hole transport material is the compound (20-H1); or the electron transport material is the compound (4-E5) and the hole transport material is the compound (20-H1). It is also more preferable that the electron transport material is the compound (4-E4), the hole transport material is the compound (20-H1), and the binder resin is the polycarbonate resin (10); or the electron transport material is the compound (4-E5), the hole transport material is the compound (20-H1), and the binder resin is the polycarbonate resin (10).

In order to inhibit generation of white spots in an image being formed particularly effectively, it is also preferable that the electron transport material is the compound (5) and the hole transport material is the compound (20) or (21). It is also more preferable that the electron transport material is the compound (5), the hole transport material is the compound (20) or (21), and the binder resin is the polycarbonate resin (10). For the same reason as above, it is also preferable that the electron transport material is the compound (5-E6) and the hole transport material is the compound (20-H1). It is also more preferable that the electron transport material is the compound (5-E6), the hole transport material is the compound (20-H1), and the binder resin is the polycarbonate resin (10). For the same reason as above, it is also preferable that the electron transport material is the compound (5-E6) and the hole transport material is the compound (21-H2). It is also more preferable that the electron transport material is the compound (5-E6), the hole transport material is the compound (21-H2), and the binder resin is the polycarbonate resin (10).

In order to inhibit generation of white spots in an image being formed particularly effectively, it is also preferable that the electron transport material is the compound (1) and the hole transport material is the compound (25). It is also more preferable that the electron transport material is the compound (1), the hole transport material is the compound (25), and the binder resin is the polycarbonate resin (10). For the same reason as above, it is also preferable that the electron transport material is the compound (1) and the hole transport material is the compound (25-H6). It is also more preferable that the electron transport material is the compound (1), the hole transport material is the compound (25-H6), and the binder resin is the polycarbonate resin (10). For the same reason as above, it is also preferable that the electron transport material is the compound (1-E1) and the hole transport material is the compound (25-H6). It is also more preferable that the electron transport material is the compound (1-E1), the hole transport material is the compound (25-H6), and the binder resin is the polycarbonate resin (10).

In order to particularly improve sensitivity characteristics of the photosensitive member while inhibiting generation of white spots in an image being formed, it is preferable that the electron transport material is the compound (2) and the hole transport material is the compound (27). It is more preferable that the electron transport material is the compound (2-E2) and the hole transport material is the compound (27-H9). For the same reason as above, it is preferable that the electron transport material is the compound (2), the hole transport material is the compound (27), and the binder resin is the polycarbonate resin (10). It is more preferable that the electron transport material is the compound (2-E2), the hole transport material is the compound (27-H9), and the binder resin is the polycarbonate resin (10).

Of the combinations of an electron transport material and a hole transport material listed above, the electron transport material and the hole transport material can for example be any of the following combinations. Furthermore, the electron transport material and the hole transport material can be any of the following combinations, and the binder resin can be the polycarbonate resin (10). Furthermore, the electron transport material and the hole transport material can be any of the following combinations, the binder resin can be the polycarbonate resin (10), and the charge generating material can be X-form metal-free phthalocyanine.

The combinations are those in which:

the electron transport material is the compound (2-E2) and the hole transport material is the compound (21-H2);

the electron transport material is the compound (2-E2) and the hole transport material is the compound (22-H3);

the electron transport material is the compound (2-E2) and the hole transport material is the compound (23-H4);

the electron transport material is the compound (2-E2) and the hole transport material is the compound (24-H5);

the electron transport material is the compound (2-E2) and the hole transport material is the compound (26-H7);

the electron transport material is the compound (2-E2) and the hole transport material is the compound (27-H8);

the electron transport material is the compound (2-E2) and the hole transport material is the compound (27-H9);

the electron transport material is the compound (1-E1) and the hole transport material is the compound (25-H6);

the electron transport material is the compound (3-E3) and the hole transport material is the compound (25-H6);

the electron transport material is the compound (4-E4) and the hole transport material is the compound (25-H6);

the electron transport material is the compound (3-E3) and the hole transport material is the compound (20-H1);

the electron transport material is the compound (4-E4) and the hole transport material is the compound (20-H1);

the electron transport material is the compound (4-E5) and the hole transport material is the compound (20-H1); or the electron transport material is the compound (5-E6) and the hole transport material is the compound (21-H2).

Of the combinations of an electron transport material and a hole transport material listed above, the electron transport material and the hole transport material can for example also be any of the following combinations. Furthermore, the electron transport material and the hole transport material can also be any of the following combinations, and the binder resin can be the polycarbonate resin (10). Furthermore, the electron transport material and the hole transport material can also be any of the following combinations, the binder resin can be the polycarbonate resin (10), and the charge generating material can be X-form metal-free phthalocyanine.

The combinations are those in which:

the electron transport material is the compound (1-E1) and the hole transport material is the compound (25-H6);

the electron transport material is the compound (4-E4) and the hole transport material is the compound (25-H6);

the electron transport material is the compound (4-E4) and the hole transport material is the compound (20-H1);

the electron transport material is the compound (4-E5) and the hole transport material is the compound (20-H1); or the electron transport material is the compound (5-E6) and the hole transport material is the compound (21-H2).

(Charge Generating Material)

No specific limitation is placed on the charge generating material as long as the charge generating material can be used in the photosensitive member. Examples of the charge generating material include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. One of the charge generating materials listed above may be used alone, or two or more of the charge generating materials listed above may be used in combination.

Examples of phthalocyanine-based pigments that can be used include metal-free phthalocyanine and metal phthalocyanine. Examples of the metal phthalocyanine include titanyl phthalocyanine, hydroxygallium phthalocyanine, and chlorogallium phthalocyanine. The metal-free phthalocyanine is for example represented by chemical formula (CGM2). Titanyl phthalocyanine is for example represented by chemical formula (CGM1).

(CGM1)

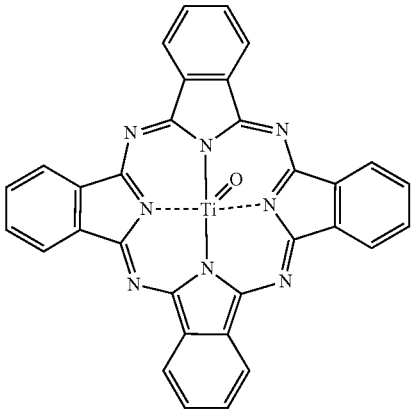

-continued (CGM2)

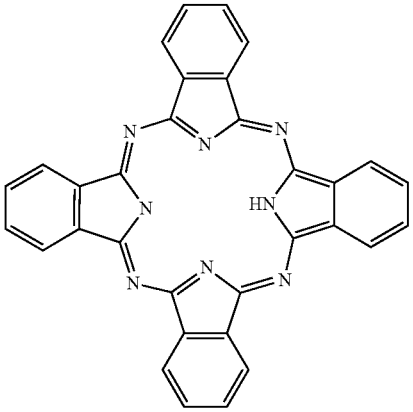

The phthalocyanine-based pigment may be crystalline or non-crystalline. No specific limitation is placed on a crystal structure (specific examples include α-form, β-form, Y-form, V-form, and II-form) of the phthalocyanine-based pigment. Phthalocyanine-based pigments having various crystal structures can be used. Examples of crystalline metal-free phthalocyanine include metal-free phthalocyanine having the X-form crystal structure (hereinafter may be referred to as X-form metal-free phthalocyanine). Examples of crystalline titanyl phthalocyanine include titanyl phthalocyanines having the α-form, β-form, and Y-form crystal structures (hereinafter may be referred to as α-form, β-form, and Y-form titanyl phthalocyanines, respectively).

For image forming apparatuses employing, for example, a digital optical system (for example, a laser beam printer or facsimile machine using a light source such as a semiconductor laser), a photosensitive member having a sensitivity in a wavelength range of 700 nm or longer is preferably used. Phthalocyanine-based pigments are preferable as the charge generating material in terms of their high quantum yield in the wavelength range of 700 nm or longer, metal-free phthalocyanine and titanyl phthalocyanine are more preferable, X-form metal-free phthalocyanine and Y-form titanyl phthalocyanine are still more preferable.

The Y-form titanyl phthalocyanine has a main peak for example at a Bragg angle (2θ±0.2°) of 27.2° in a CuKα characteristic X-ray diffraction spectrum. The main peak in the CuKα characteristic X-ray diffraction spectrum is a peak having the largest or second largest intensity in a Bragg angle (2θ±0.2°) range of at least 3° and no greater than 40°.

The following describes an example of a method for measuring the CuKα characteristic X-ray diffraction spectrum. A sample (titanyl phthalocyanine) is loaded into a sample holder of an X-ray diffraction spectrometer (for example, "RINT (registered Japanese trademark) 1100" manufactured by Rigaku Corporation) and an X-ray diffraction spectrum is measured using a Cu X-ray tube under conditions of a tube voltage of 40 kV, a tube current of 30 mA, and a wavelength of CuKα characteristic X-rays of 1.542 Å. The measurement range (2θ) is for example at least 3° and no greater than 40° (start angle: 3°, stop angle: 40°) and the scanning rate is for example 10°/minute.

For photosensitive members adopted in image forming apparatuses using a short-wavelength laser light source (for example, a laser light source having a wavelength of at least 350 nm and no longer than 550 nm), anthanthrone-based pigments are preferably used as the charge generating material.

The amount of the charge generating material is preferably at least 0.1 parts by mass and no greater than 50 parts by mass relative to 100 parts by mass of the binder resin contained in the photosensitive layer, more preferably at least 0.5 parts by mass and no greater than 30 parts by mass, and particularly preferably at least 0.5 parts by mass and no greater than 4.5 parts by mass.

(Additives)

Examples of additives that can be used include antidegradants (specific examples include antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of antioxidants that can be used include hindered phenols (specific examples include di(tert-butyl)p-cresol), hindered amines, paraphenylenediamines, arylalkanes, hydroquinone, spirochromanes, spiroindanones, derivatives of the aforementioned materials, organosulfur compounds, and organophosphorus compounds.

<Conductive Substrate>

No specific limitation is placed on the conductive substrate as long as the conductive substrate can be used in the photosensitive member. It is only required that at least a surface portion of the conductive substrate is formed from an electrically conductive material. An example of the conductive substrate is formed from an electrically conductive material. Another example of the conductive substrate is coated with an electrically conductive material. Examples of the electrically conductive material include aluminum, iron, copper, tin, platinum, silver, vanadium, molybdenum, chromium, cadmium, titanium, nickel, palladium, indium, stainless steel, and brass. One of the electrically conductive materials listed above may be used alone, or two or more of the electrically conductive materials listed above may be used in combination (for example, as an alloy). Among the electrically conductive materials listed above, aluminum and aluminum alloys are preferable in terms of favorable charge mobility from the photosensitive layer to the conductive substrate.

The shape of the conductive substrate is appropriately selected according to a structure of an image forming apparatus. Examples of the shape of the conductive substrate include a sheet-like shape and a drum-like shape. Also, the thickness of the conductive substrate is appropriately selected according to the shape of the conductive substrate.

<Intermediate Layer>

The intermediate layer (undercoat layer) contains for example inorganic particles and a resin for the intermediate layer (an intermediate layer resin). The presence of the intermediate layer is thought to cause a smooth flow of an electric current generated by irradiation of the photosensitive member with light, resulting in suppression of an increase in resistance while maintaining insulation to such an extent that occurrence of a leakage current can be prevented.

Examples of the inorganic particles include particles of metals (specific examples include aluminum, iron, and copper) and metal oxides (specific examples include titanium oxide, alumina, zirconium oxide, tin oxide, and zinc oxide) and particles of non-metal oxides (specific examples include silica). One type of the inorganic particles listed above may be used alone, or two or more types of the inorganic particles listed above may be used in combination.

No specific limitation is placed on the intermediate layer resin as long as it can be used for formation of the intermediate layer. The intermediate layer may contain an additive. Examples of the additive contained in the intermediate layer are the same as those listed for the photosensitive layer.

<Method for Producing Photosensitive Member>

The photosensitive member is for example produced as described below. The photosensitive member is produced by applying an application liquid for photosensitive layer formation onto the conductive substrate and drying the applied application liquid for photosensitive layer formation. The application liquid for photosensitive layer formation is prepared by dissolving or dispersing a charge generating material, an electron transport material, a binder resin, a hole transport material, and an optionally added component (for example, an additive) in a solvent.

No specific limitation is placed on the solvent contained in the application liquid for photosensitive layer formation as long as the respective components to be contained in the application liquid can be dissolved or dispersed therein. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. One of the solvents listed above is used alone, or two or more of the solvents listed above are used in combination. In order to improve workability during production of the photosensitive member, non-halogenated solvents (solvents other than halogenated hydrocarbons) are preferably used.

The application liquid is prepared by mixing the components to disperse the components in the solvent. Mixing or dispersion may be performed using for example a bead mill, a roll mill, a ball mill, an attritor, a paint shaker, or an ultrasonic disperser.

The application liquid for photosensitive layer formation may contain for example a surfactant in order to improve dispersibility of the respective components.

No specific limitation is placed on a method for applying the application liquid for photosensitive layer formation as long as the application liquid can be uniformly applied over the conductive substrate. Examples of the method for applying include blade coating, dip coating, spray coating, spin coating, and bar coating.

No specific limitation is placed on a method for drying the application liquid for photosensitive layer formation as long as the solvent contained in the application liquid can be evaporated. Examples of the method for drying include thermal treatment (hot-air drying) using a high-temperature dryer or a reduced pressure dryer. The temperature of the thermal treatment is for example at least 40° C. and no higher than 150° C. The time of the thermal treatment is for example at least 3 minutes and no longer than 120 minutes.

Either or both of forming the intermediate layer and forming the protective layer may be included in the method for producing the photosensitive member, as necessary. A process appropriately selected from known processes is adopted in forming the intermediate layer and forming the protective layer.

<Image Forming Apparatus>

The following describes an image forming apparatus including the photosensitive member of the present embodiment. The following describes with reference to FIG. 3 a tandem-type color image forming apparatus as an example of the image forming apparatus including the photosensitive member of the present embodiment.

Figure 3:
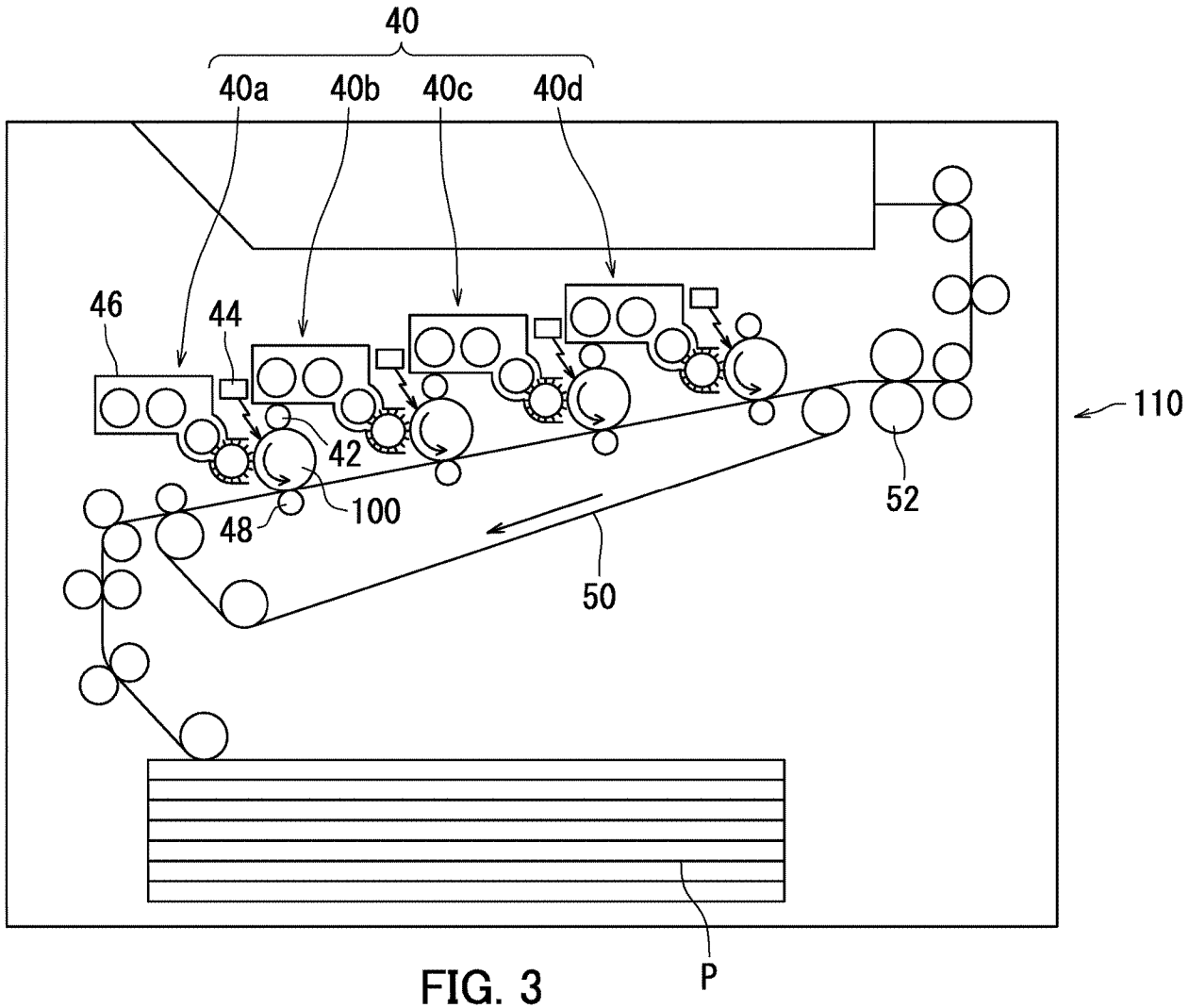
FIG. 3 is a diagram illustrating an example of a configuration of an image forming apparatus including the electrophotographic photosensitive member according to the embodiment of the present disclosure.

An image forming apparatus 110 illustrated in FIG. 3 includes image forming units 40*a*, 40*b*, 40*c*, and 40*d*, a transfer belt 50, and a fixing device 52. In the following description, each of the image forming units 40*a*, 40*b*, 40*c*, and 40*d* will be referred to as an image forming unit 40 when there is no need to distinguish the respective image forming units from one another.

The image forming unit 40 includes an image bearing member, a charger 42, a light exposure device 44, a developing device 46, and a transfer device 48. The image bearing member is the photosensitive member 100 of the present embodiment. The photosensitive member 100 is located at the center of the image forming unit 40. The photosensitive member 100 is rotatable in a direction indicated by an arrow (i.e., counterclockwise). The charger 42, the light exposure device 44, the developing device 46, and the transfer device 48 are arranged around the photosensitive member 100 in the stated order from the upstream side in the rotation direction of the photosensitive member 100. Note that the image forming unit 40 may further include a non-illustrated cleaning device or a non-illustrated static eliminating device.

The image forming units 40*a* to 40*d* superimpose toner images in respective colors (for example, four colors of black, cyan, magenta, and yellow) on one another in order on a recording medium P on the transfer belt 50.

The charger 42 charges a surface (for example, a circumferential surface) of the photosensitive member 100. Charging polarity of the charger 42 is positive. That is, the charger 42 positively charges the surface of the photosensitive member 100. When the photosensitive member 100 of the present embodiment and the recording medium P come into contact with each other and friction is caused therebetween, minute components of the recording medium P (for example, paper dust) are positively charged to a level equal to or higher than a desired level. When the surface of the photosensitive member 100 is positively charged by the charger 42, the surface of the photosensitive member 100 and the minute components of the recording medium P positively charged through triboelectric charging electrically repel each other. As a result, the minute components of the recording medium P hardly adhere to the surface of the photosensitive member 100 and generation of white spots in an image being formed can be favorably inhibited.

The charger 42 is a charging roller. The charging roller charges the surface of the photosensitive member 100 while in contact therewith. A contact-type charging process is adopted in the image forming apparatus 110. In image forming apparatuses adopting the contact-type charging process, a charging roller in contact with a surface of a photosensitive member normally presses minute components of a recording medium against the surface of the photosensitive member. Therefore, the minute components of the recording medium tend to firmly adhere to the surface of the photosensitive member. However, the image forming apparatus 110 includes the photosensitive member 100 of the present embodiment. The photosensitive member 100 of the present embodiment is capable of inhibiting generation of white spots that would be caused by adhesion of minute components. Therefore, even in a configuration in which the image forming apparatus 110 includes the charging roller as the charger 42, minute components hardly adhere to the surface of the photosensitive member 100 and generation of white spots in an image being formed can be inhibited.

An example of chargers adopting the contact-type charging process other than the charging roller is a charging brush. Note that the charger may adopt a non-contact-type charging process. Examples of chargers adopting the non-contact-type charging process include a corotron charger and a scorotron charger.

The light exposure device 44 irradiates the charged surface of the photosensitive member 100 with light. Through the above, an electrostatic latent image is formed on the surface of the photosensitive member 100. The electrostatic latent image is formed on the basis of image data input to the image forming apparatus 110.

The developing device 46 develops the electrostatic latent image into a toner image by supplying toner to the surface of the photosensitive member 100. The photosensitive member 100 is the image bearing member that bears the toner image thereon. The toner may be used as a one-component developer. Alternatively, the toner may be mixed with a given carrier and may be used in the form of a two-component developer. In a situation in which the toner is used as the one-component developer, the developing device 46 supplies the one-component developer, which is the toner, to the electrostatic latent image formed on the photosensitive member 100. In a situation in which the toner is used in the form of the two-component developer, the developing device 46 supplies to the electrostatic latent image formed on the photosensitive member 100 the toner from the two-component developer containing the toner and the carrier.

The developing device 46 is capable of developing the electrostatic latent image into the toner image while in contact with the surface of the photosensitive member 100. That is, a contact-type developing process can be adopted in the image forming apparatus 110. In image forming apparatuses adopting the contact-type developing process, a developing device in contact with a surface of a photosensitive member normally presses minute components of a recording medium against the surface of the photosensitive member. Therefore, the minute components of the recording medium tend to firmly adhere to the surface of the photosensitive member. However, the image forming apparatus 110 includes the photosensitive member 100 of the present embodiment. The photosensitive member 100 of the present embodiment is capable of inhibiting generation of white spots that would be caused by adhesion of minute components of the recording medium P. Therefore, even in a configuration in which the image forming apparatus 110 includes the developing device 46 adopting the contact-type developing process, minute components hardly adhere to the surface of the photosensitive member 100 and generation of white spots in an image being formed can be inhibited.

The developing device 46 is capable of cleaning the surface of the photosensitive member 100. That is, a blade cleaner-less process can be adopted in the image forming apparatus 110. In this configuration, the developing device 46 is capable of removing residual components on the surface of the photosensitive member 100. In image forming apparatuses including a cleaning device (for example, a cleaning blade), residual components on a surface of an image bearing member are normally scraped off by the cleaning device. However, in image forming apparatuses adopting the blade cleaner-less process, residual components on the surface of the image bearing member are not scraped off. Therefore, in the image forming apparatuses adopting the blade cleaner-less process, the residual components normally tend to remain on the surface of the image bearing member. However, the photosensitive member 100 of the present embodiment is capable of inhibiting generation of white spots that would be caused by adhesion of minute components of the recording medium P (for example, paper dust). Therefore, even in a configuration in which the blade cleaner-less process is adopted in the image forming apparatus 110 including the photosensitive member 100 as above, residual components, particularly the minute components of the recording medium P, hardly remain on the surface of the photosensitive member 100. As a result, the image forming apparatus 110 is capable of inhibiting generation of white spots in an image being formed.

In order that the developing device 46 efficiently cleans the surface of the photosensitive member 100 while performing development, it is preferable that the following conditions (a) and (b) are satisfied.

Condition (a): The contact-type developing process is adopted and there is a difference in peripheral speed (rotational speed) between the photosensitive member 100 and the developing device 46.

Condition (b): A surface potential of the photosensitive member 100 and an electric potential of a development bias satisfy the following expressions (b-1) and (b-2).

0 (V)<electric potential (V) of development bias<surface potential (V) of a region of photosensitive member 100 that is not exposed to light (b-1)

electric potential (V) of development bias>surface potential (V) of a region of photosensitive member 100 that is exposed to light>0 (V) (b-2)

In a situation in which the contact-type developing process is adopted and there is a difference in peripheral speed between the photosensitive member 100 and the developing device 46 as described in the condition (a), the surface of the photosensitive member 100 comes into contact with the developing device 46 and components adhering to the surface of the photosensitive member 100 are removed by friction between the surface of the photosensitive member 100 and the developing device 46. The peripheral speed of the developing device 46 is preferably faster than that of the photosensitive member 100.

The condition (b) is a condition to be satisfied in a situation in which a reversal developing process is adopted as the developing process. In order to improve sensitivity characteristics of the photosensitive member 100, which is a single-layer electrophotographic photosensitive member, it is preferable that charging polarity of toner, a surface potential of a region of the photosensitive member 100 that is not exposed to light, a surface potential of a region of the photosensitive member 100 that is exposed to light, and an electric potential of a development bias are all positive. Note that the surface potential of the region of the photosensitive member 100 that is not exposed to light and the surface potential of the region of the photosensitive member 100 that is exposed to light are measured after a toner image is transferred from the photosensitive member 100 to the recording medium P by the transfer device 48 and before the surface of the photosensitive member 100 is charged by the charger 42 in a next turn of the photosensitive member 100.

In a situation in which the expression (b-1) of the condition (b) is satisfied, electrostatic repelling force acting between toner remaining on the photosensitive member 100 (hereinafter may be referred to as residual toner) and the region of the photosensitive member 100 that is not exposed to light is larger than electrostatic repelling force acting between the residual toner and the developing device 46. Therefore, residual toner remaining on the region of the photosensitive member 100 that is not exposed to light moves from the surface of the photosensitive member 100 to the developing device 46 and is collected.

In a situation in which the expression (b-2) of the condition (b) is satisfied, electrostatic repelling force acting between the residual toner and the region of the photosensitive member 100 that is exposed to light is smaller than the electrostatic repelling force acting between the residual toner and the developing device 46. Therefore, residual toner remaining on the region of the photosensitive member 100 that is exposed to light is held on the surface of the photosensitive member 100. Toner held on the region of the photosensitive member 100 that is exposed to light is used for image formation.

The transfer belt 50 conveys the recording medium P to between the photosensitive member 100 and the transfer device 48. The transfer belt 50 is an endless belt. The transfer belt 50 is capable of circulating in a direction indicated by an arrow (i.e., clockwise).

The transfer device 48 transfers the toner image developed by the developing device 46 from the surface of the photosensitive member 100 onto the recording medium P. The transfer device 48 transfers the toner image from the surface of the photosensitive member 100 onto the recording medium P while the recording medium P and the surface of the photosensitive member 100 are in contact with each other. That is, a direct transfer process is adopted in the image forming apparatus 110. In image forming apparatuses adopting the direct transfer process, a photosensitive member and a recording medium normally come into contact with each other with a result that minute components of the recording medium (for example, paper dust) tend to adhere to a surface of the photosensitive member. However, the photosensitive member 100 of the present embodiment is capable of inhibiting adhesion of minute components of the recording medium P to the surface of the photosensitive member 100. As a result, generation of white spots in an image being formed can be favorably inhibited. An example of the transfer device 48 is a transfer roller.

The fixing device 52 applies heat and/or pressure to the unfixed toner image transferred onto the recording medium P by the transfer device 48. The fixing device 52 is for example a heating roller and/or a pressure roller. Through application of heat and/or pressure to the toner image, the toner image is fixed to the recording medium P. As a result, an image is formed on the recording medium P.

Through the above, an example of the image forming apparatus has been described. However, the image forming apparatus is not limited to the image forming apparatus 110 described above. Although the image forming apparatus 110 described above is an image forming apparatus for color printing, the image forming apparatus may be an image forming apparatus for monochrome printing. In this case, the image forming apparatus may include a single image forming unit only, for example. Although the image forming apparatus 110 described above is a tandem-type image forming apparatus, the image forming apparatus may be a rotary-type image forming apparatus, for example.

<Process Cartridge>

The following describes an example of a process cartridge including the photosensitive member 100 of the present embodiment, continuously referring to FIG. 3. The process cartridge is a cartridge used for image formation. The process cartridge corresponds to each of the image forming units 40*a* to 40*d*. The process cartridge includes the photosensitive member 100. The process cartridge may further include at least one device selected from the group consisting of the charger 42, the light exposure device 44, the developing device 46, and the transfer device 48 in addition to the photosensitive member 100. The process cartridge may further include either or both of a non-illustrated cleaning device and a non-illustrated static eliminating device. The process cartridge is attachable to and detachable from the image forming apparatus 110. Therefore, the process cartridge is easy to handle and can be easily and quickly replaced together with the photosensitive member 100 when sensitivity characteristics or the like of the photosensitive member 100 is degraded. Through the above, the process cartridge including the photosensitive member 100 of the present embodiment has been described with reference to FIG. 3.

The above-described photosensitive member of the present embodiment is capable of inhibiting generation of white spots in an image being formed. Also, the process cartridge and the image forming apparatus that include the photosensitive member of the present embodiment are capable of inhibiting generation of white spots in an image being formed.

EXAMPLES

The following more specifically describes the present disclosure using examples. However, the present disclosure is by no means limited to the scope of the examples.

<Materials for Forming Photosensitive Layer>

The following charge generating material, hole transport materials, electron transport materials, and a binder resin were prepared as materials for forming photosensitive layers of photosensitive members.

(Charge Generating Material)

X-form metal-free phthalocyanine was prepared as a charge generating material. The X-form metal-free phthalocyanine was metal-free phthalocyanine having an X-form crystal structure and represented by chemical formula (CGM2) described in the above embodiment.

(Hole Transport Material)

The compounds (20-H1), (21-H2), (22-H3), (23-H4), (24-H5), (25-H6), (26-H7), (27-H8), and (27-H9) described in the above embodiment were prepared as hole transport materials. Compounds represented by chemical formulas (H10) to (H13) shown below (hereinafter respectively referred to as compounds (H10) to (H13)) were prepared as hole transport materials to be used in comparative examples.

(H10)

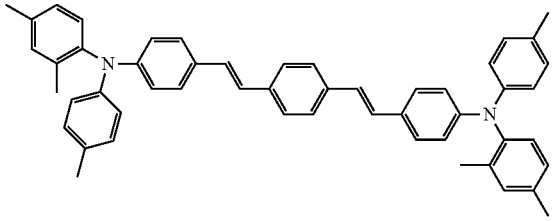

-continued (H11)

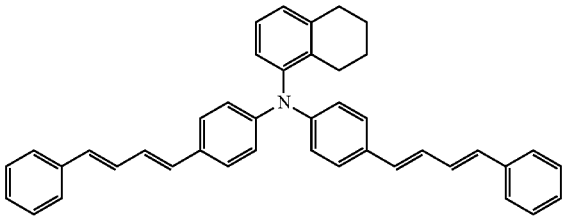

(H12)

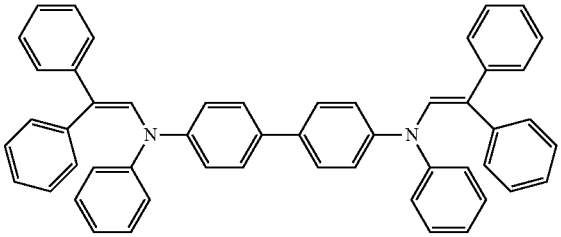

(H13)

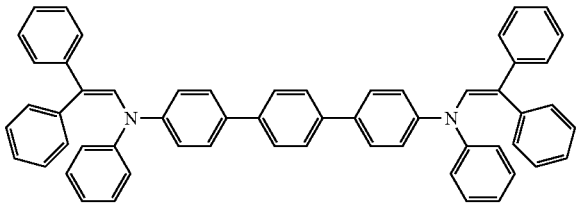

(Electron Transport Material)

The compounds (1-E1), (2-E2), (3-E3), (4-E4), (4-E5), and (5-E6) described in the above embodiment were prepared as electron transport materials. Also, compounds represented by chemical formulas (E7) to (E11) shown below (hereinafter respectively referred to as compounds (E7) to (E11)) were prepared as electron transport materials to be used in comparative examples.

(E7)

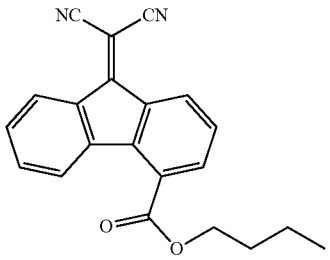

(E8)

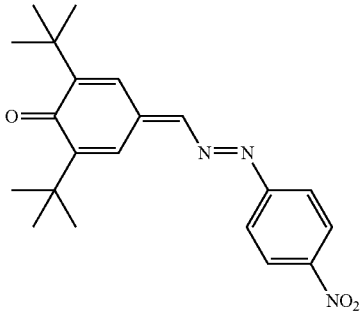

-continued (E9)

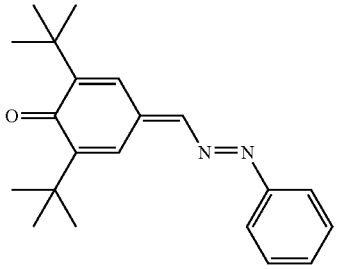

(E10)

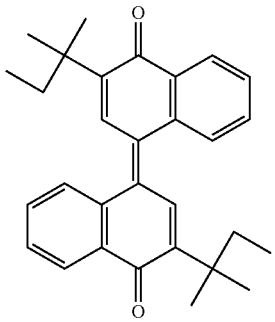

(E11)

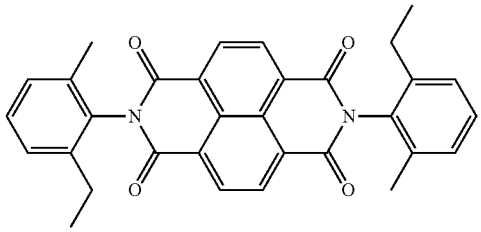

(Binder Resin)

The polycarbonate resin (10) described in the above embodiment was prepared as a binder resin. The polycarbonate resin (10) had a viscosity average molecular weight of 33,000.

<Production of Photosensitive Member>

Photosensitive members (A-1) to (A-18) and (B-1) to (B-9) were produced using the materials for forming the photosensitive layers.

(Production of Photosensitive Member (A-1))

A vessel was charged with 2 parts by mass of the X-form metal-free phthalocyanine as the charge generating material, 50 parts by mass of the compound (20-H1) as the hole transport material, 30 parts by mass of the compound (2-E2) as the electron transport material, 100 parts by mass of the polycarbonate resin (10) as the binder resin, and 600 parts by mass of tetrahydrofuran as a solvent. The vessel contents were mixed for 12 hours using a ball mill to disperse the materials in the solvent. Through the above, an application liquid for photosensitive layer formation was prepared. The application liquid for photosensitive layer formation was applied by dip coating onto a drum-shaped aluminum support (diameter: 30 mm, entire length: 238.5 mm) as a conductive substrate. The applied application liquid for photosensitive layer formation was dried with hot air at 120° C. for 80 minutes. Through the above, a photosensitive layer of a single-layer structure (film thickness: 30 μm) was formed on the conductive substrate. As a result, the photosensitive member (A-1) was obtained.

(Production of Photosensitive Members (A-2) to (A-18) and (B-1) to (B-9))

The photosensitive members (A-2) to (A-18) and (B-1) to (B-9) were produced in the same manner as in production of the photosensitive member (A-1) in all aspects other than the following changes. Electron transport materials shown in Tables 1 and 2 were used in production of the photosensitive members (A-2) to (A-18) and (B-1) to (B-9) while the compound (2-E2) was used as the electron transport material in production of the photosensitive member (A-1). Hole transport materials shown in Tables 1 and 2 were used in production of the photosensitive members (A-2) to (A-18) and (B-1) to (B-9) while the compound (20-H1) was used as the hole transport material in production of the photosensitive member (A-1).

<Measurement of Charge of Calcium Carbonate>

A charge of calcium carbonate was measured for each of the photosensitive members (A-1) to (A-18) and (B-1) to (B-9).

The following describes a method for measuring the charge of calcium carbonate by charging the calcium carbonate through friction with the photosensitive layer 102 with reference to FIG. 2 again. The charge of calcium carbonate was measured by first through fourth steps described below. A jig 10 was used in measurement of the charge of calcium carbonate.

The jig 10 includes a first table 12, a rotary shaft 14, a rotary driving device 16 (for example, a motor), and a second table 18. The rotary driving device 16 causes the rotary shaft 14 to rotate. The rotary shaft 14 rotates about a rotation axis S thereof. The first table 12 rotates together with the rotary shaft 14 about the rotation axis S. The second table 18 is fixed and does not rotate.

(First Step)

In the first step, two photosensitive layers 102 were prepared. In the following description, one of the photosensitive layers 102 will be referred to as a first photosensitive layer 102*a* and the other of the photosensitive layers 102 will be referred to as a second photosensitive layer 102*b*. First, a first film 20 with the first photosensitive layer 102*a* formed thereon was prepared. The first photosensitive layer 102*a* had a film thickness L1 of 30 μm. Also, a second film 22 with the second photosensitive layer 102*b* formed thereon was prepared. The second photosensitive layer 102*b* had a film thickness L2 of 30 μm. Overhead projector (OHP) films were used as the first film 20 and the second film 22. The first film 20 and the second film 22 each had a circular shape of a diameter of 3 cm. The application liquid for photosensitive layer formation used in production of the photosensitive member (A-1) was applied over the first film 20 and the second film 22. The applied application liquid for photosensitive layer formation was dried with hot air at 120° C. for 80 minutes. Through the above, the first film 20 with the first photosensitive layer 102*a* formed thereon and the second film 22 with the second photosensitive layer 102*b* formed thereon were obtained.

(Second Step)

In the second step, 0.007 g of calcium carbonate was applied over the first photosensitive layer 102*a*. Through the above, the calcium carbonate layer 24 was formed from calcium carbonate on the first photosensitive layer 102*a*. Then, the second photosensitive layer 102*b* was superposed on the calcium carbonate layer 24. Specifically, the second step was performed as described below.

First, the first film 20 was fixed to the first table 12 using a double sided tape. Then, 0.007 g of calcium carbonate was applied over the first photosensitive layer 102*a* on the first film 20. Through the above, the calcium carbonate layer 24 formed from calcium carbonate was formed on the first photosensitive layer 102*a*. The second film 22 was fixed to the second table 18 using the double sided tape such that the calcium carbonate layer 24 is in contact with the second photosensitive layer 102*b*. As a result, the first table 12, the first film 20, the first photosensitive layer 102*a*, the calcium carbonate layer 24, the second photosensitive layer 102*b*, the second film 22, and the second table 18 were arranged in the stated order from the bottom to the top. The first table 12, the first film 20, the first photosensitive layer 102*a*, the second photosensitive layer 102*b*, the second film 22, and the second table 18 were arranged such that respective centers thereof coincide with the rotation axis S.

(Third Step)

In the third step, the first photosensitive layer 102*a* was rotated at a rotational speed of 60 rpm for 60 seconds while keeping the second photosensitive layer 102*b* stationary in an environment at a temperature of 23° C. and a relative humidity of 50%. Specifically, the rotary shaft 14, the first table 12, the first film 20, and the first photosensitive layer 102*a* were rotated about the rotation axis S at the rotational speed of 60 rpm for 60 seconds by driving the rotary driving device 16. Thus, calcium carbonate contained in the calcium carbonate layer 24 was charged through friction with the first photosensitive layer 102*a* and the second photosensitive layer 102*b*.

(Fourth Step)

In the fourth step, the calcium carbonate charged in the third step was collected from the jig 10 and sucked using a charge measuring device (compact draw-off charge measurement system "MODEL 212HS", product of TREK, INC.). A total electric charge Q (unit: +μC) and a mass M (unit: g) of the sucked calcium carbonate were measured using the charge measuring device. A charge of the calcium carbonate (triboelectric charge, unit: +μC/g) was calculated according to the following formula "charge=Q/M".

Through the above, the method for measuring the charge of calcium carbonate by charging the calcium carbonate through friction with the photosensitive layer 102 has been described with reference to FIG. 2. Other than the following change, a charge of calcium carbonate was measured for each of the photosensitive members (A-2) to (A-18) and (B-1) to (B-9) by the same method as that used in measurement of the charge of calcium carbonate for the photosensitive member (A-1). In the first step, respective application liquids for photosensitive layer formation used in production of the photosensitive members (A-2) to (A-18) and (B-1) to (B-9) were used instead of the application liquid for photosensitive layer formation used in production of the photosensitive member (A-1).

The charge of calcium carbonate calculated for each of the photosensitive members (A-1) to (A-18) and (B-1) to (B-9) is shown in Table 1 or 2. A larger positive value of the charge of calcium carbonate indicates that calcium carbonate was positively charged more easily relative to the photosensitive layer.

<Measurement of Vickers Hardness>

A Vickers hardness of the photosensitive layer at 45° C. was measured for each of the photosensitive members (A-1) to (A-18) and (B-1) to (B-9). The Vickers hardness of the photosensitive layer was measured by a method in accordance with Japanese Industrial Standard (JIS) Z2244. First, the photosensitive member was heated using a heater to raise the temperature of the photosensitive layer up to 45° C. Next, the Vickers hardness of the photosensitive layer was measured using a hardness tester ("Micro Vickers Hardness Tester DMH-1", product of Matsuzawa Co., Ltd.) while the temperature of the photosensitive layer was maintained at 45° C. The hardness tester had a diamond indenter. The Vickers hardness was measured under conditions of a diamond indenter load (test force) of 10 gf, a time to reach the test force of 5 seconds, a diamond indenter approach velocity of 2 mm/second, and a test force hold time of 1 second. The thus measured Vickers hardness of the photosensitive layer at 45° C. is shown in Tables 1 and 2.

<Evaluation of Sensitivity Characteristics>

Sensitivity characteristics were evaluated for each of the photosensitive members (A-1) to (A-18) and (B-1) to (B-9). The sensitivity characteristics were evaluated in an environment at a temperature of 23° C. and a relative humidity of 50%. First, a surface of the photosensitive member was charged to +600 V using a drum sensitivity test device (product of Gen-Tech, Inc.). Then, monochromatic light (wavelength: 780 nm, half-width: 20 nm, light intensity: 1.5 $\mu J/cm^2$) was obtained from white light of a halogen lamp using a bandpass filter. The surface of the photosensitive member was irradiated with the obtained monochromatic light. A surface potential of the photosensitive member was measured when 0.5 seconds elapsed from termination of irradiation. The thus measured surface potential was determined to be a post-irradiation potential ($V_L$, unit: +V). The post-irradiation potential ($V_L$) of each photosensitive member is shown in Tables 1 and 2. A smaller positive value of the post-irradiation potential ($V_L$) indicates better sensitivity characteristics of the photosensitive member.

<Evaluation of Image Characteristics>

Image characteristics were evaluated for each of the photosensitive members (A-1) to (A-18) and (B-1) to (B-9). The image characteristics were evaluated in an environment at a temperature of 32.5° C. and a relative humidity of 80%. An image forming apparatus ("Monochrome Printer FS-1300D", product of KYOCERA Document Solutions Inc.) was modified to be used as an evaluation apparatus. Specifically, Monochrome Printer FS-1300D was modified to change the non-contact-type developing process to the contact-type developing process, change a blade cleaning process to a bladeless cleaning process, and change a scorotron charger to a charging roller. Note that the evaluation apparatus employed a direct transfer process. A recording medium used was "KYOCERA Document Solutions brand paper VM-A4" (A4 size) sold by KYOCERA Document Solutions Inc. A one-component developer (test sample) was used in evaluation performed using the evaluation apparatus.

An image I (an image with a coverage of 1%) was continuously printed on each of 20,000 sheets of the paper (recording mediums) using the evaluation apparatus under conditions of a rotational speed of the photosensitive member of 168 mm/second and a charge potential of +630 V. Then, an image II (a black solid image of A4 size) was printed on a sheet of the paper (recording medium). The recording medium with the image II formed thereon was observed with unaided eyes and the number of white spots observed in the image II was counted. The number of white spots in the image II tends to increase as a result of an increase of minute components (for example, paper dust) of the recording medium adhering to the surface of the photosensitive member. The number of white spots observed in the image II is shown in Tables 1 and 2.

HTM, ETM, Resin, $V_L$, and Vickers hardness in Tables 1 and 2 respectively represent the hole transport material, the electron transport material, the binder resin, the post-irradiation potential, and the Vickers hardness of the photosensitive layer at 45° C.

TABLE 1

| | Photosensitive member | Photosensitive layer Resin | ETM | HTM | Vickers hardness (HV) | Charge of calcium carbonate (+μC/g) | Sensitivity characteristics $V_L$ (+V) | Image characteristics White spot count |
|---|---|---|---|---|---|---|---|---|
| Example 1 | A-1 | 10 | 2-E2 | 20-H1 | 18.2 | 6.8 | 124 | 26 |
| Example 2 | A-2 | 10 | 2-E2 | 21-H2 | 18.1 | 6.9 | 129 | 28 |
| Example 3 | A-3 | 10 | 2-E2 | 22-H3 | 19.9 | 6.8 | 132 | 25 |
| Example 4 | A-4 | 10 | 2-E2 | 23-H4 | 20.2 | 6.8 | 132 | 27 |
| Example 5 | A-5 | 10 | 2-E2 | 24-H5 | 19.7 | 6.9 | 129 | 26 |
| Example 6 | A-6 | 10 | 2-E2 | 25-H6 | 18.3 | 6.9 | 126 | 25 |
| Example 7 | A-7 | 10 | 2-E2 | 26-H7 | 18.4 | 6.9 | 121 | 27 |
| Example 8 | A-8 | 10 | 2-E2 | 27-H8 | 19.1 | 6.8 | 132 | 25 |
| Example 9 | A-9 | 10 | 2-E2 | 27-H9 | 18.1 | 6.8 | 119 | 25 |
| Example 10 | A-10 | 10 | 1-E1 | 25-H6 | 18.5 | 7.6 | 126 | 22 |
| Example 11 | A-11 | 10 | 3-E3 | 25-H6 | 19.0 | 8.2 | 127 | 21 |
| Example 12 | A-12 | 10 | 4-E4 | 25-H6 | 18.5 | 7.9 | 129 | 24 |
| Example 13 | A-13 | 10 | 1-E1 | 20-H1 | 18.5 | 7.7 | 124 | 22 |
| Example 14 | A-14 | 10 | 3-E3 | 20-H1 | 19.4 | 8.0 | 133 | 21 |
| Example 15 | A-15 | 10 | 4-E4 | 20-H1 | 18.8 | 7.8 | 130 | 20 |
| Example 16 | A-16 | 10 | 4-E5 | 20-H1 | 18.3 | 8.1 | 129 | 18 |
| Example 17 | A-17 | 10 | 5-E6 | 20-H1 | 17.9 | 8.2 | 127 | 19 |
| Example 18 | A-18 | 10 | 5-E6 | 21-H2 | 19.0 | 7.4 | 124 | 21 |

TABLE 2

| | Photosensitive member | Photosensitive layer Resin | ETM | HTM | Vickers hardness (HV) | Charge of calcium carbonate (+μC/g) | Sensitivity characteristics $V_L$ (+V) | Image characteristics White spot count |
|---|---|---|---|---|---|---|---|---|
| Comparative Example 1 | B-1 | 10 | E7 | 20-H1 | 18.3 | 5.6 | 125 | 42 |
| Comparative Example 2 | B-2 | 10 | E8 | 20-H1 | 18.6 | 5.5 | 122 | 38 |
| Comparative Example 3 | B-3 | 10 | E9 | 20-H1 | 18.5 | 5.3 | 137 | 40 |
| Comparative Example 4 | B-4 | 10 | E10 | 20-H1 | 18.5 | 5.8 | 125 | 39 |
| Comparative Example 5 | B-5 | 10 | E11 | 20-H1 | 17.8 | 5.4 | 123 | 42 |
| Comparative Example 6 | B-6 | 10 | 2-E2 | H10 | 14.1 | 6.9 | 121 | 50 |
| Comparative Example 7 | B-7 | 10 | 2-E2 | H11 | 13.7 | 6.8 | 130 | 48 |
| Comparative Example 8 | B-8 | 10 | 2-E2 | H12 | 16.4 | 6.7 | 124 | 39 |
| Comparative Example 9 | B-9 | 10 | 2-E2 | H13 | 15.3 | 6.8 | 133 | 44 |

The photosensitive members (A-1) to (A-18) each included a conductive substrate and a photosensitive layer having a single-layer structure. The photosensitive layer contained a charge generating material, an electron transport material, a polycarbonate resin, and a hole transport material. The electron transport material included the compound (1), (2), (3), (4), or (5). Specifically, the photosensitive layer contained the compound (1-E1), (2-E2), (3-E3), (4-E4), (4-E5), or (5-E6) as the electron transport material. The hole transport material included the compound (20), (21), (22), (23), (24), (25), (26), or (27). Specifically, the photosensitive layer contained the compound (20-H1), (21-H2), (22-H3), (23-H4), (24-H5), (25-H6), (26-H7), (27-H8), or (27-H9) as the hole transport material. The charge of calcium carbonate as measured by charging the calcium carbonate through friction with the photosensitive layer was at least +6.5 μC/g. The Vickers hardness of the photosensitive layer at 45° C. was at least 17.0 HV. Therefore, with respect to each of the photosensitive members (A-1) to (A-18), the number of white spots in the formed image was small as shown in Table 1, indicating that the photosensitive member inhibited generation of white spots. Also, generation of white spots in the image being formed could be inhibited without impairing sensitivity characteristics of the photosensitive members (A-1) to (A-18).

The photosensitive members (A-15) and (A-16) each contained an electron transport material including the compound (4). Specifically, the photosensitive layer thereof contained the compound (4-E4) or (4-E5) as the electron transport material. Furthermore, the photosensitive members (A-15) and (A-16) each contained a hole transport material including the compound (20). Specifically, the photosensitive layer thereof contained the compound (20-H1) as the hole transport material. Therefore, with respect to each of the photosensitive members (A-15) and (A-16), the number of white spots in the formed image was 20 or less as shown in Table 1, indicating that the photosensitive member inhibited generation of white spots particularly effectively.

The photosensitive members (A-17) and (A-18) each contained an electron transport material including the compound (5). Specifically, the photosensitive layer thereof contained the compound (5-E6) as the electron transport material. Furthermore, the photosensitive members (A-17) and (A-18) each contained a hole transport material including the compound (20) or (21). Specifically, the photosensitive layer thereof contained the compound (20-H1) or (21-H2) as the hole transport material. Therefore, with respect to the photosensitive member (A-17), the number of white spots in the formed image was 19 as shown in Table 1, indicating that the photosensitive member inhibited generation of white spots particularly effectively. With respect to the photosensitive member (A-18), the number of white spots in the formed image was 21, indicating that the photosensitive member inhibited generation of white spots particularly effectively.

The photosensitive member (A-10) contained an electron transport material including the compound (1). Specifically, the photosensitive layer thereof contained the compound (1-E1) as the electron transport material. The photosensitive member (A-10) contained a hole transport material including the compound (25). Specifically, the photosensitive layer thereof contained the compound (25-H6) as the hole transport material. Therefore, with respect to the photosensitive member (A-10), the number of white spots in the formed image was 22 as shown in Table 1, indicating that the photosensitive member inhibited generation of white spots particularly effectively.

The photosensitive member (A-9) contained an electron transport material including the compound (2). Specifically, the photosensitive layer thereof contained the compound (2-E2) as the electron transport material. The photosensitive member (A-9) contained a hole transport material including the compound (27). Specifically, the photosensitive layer thereof contained the compound (27-H9) as the hole transport material. Therefore, as shown in Table 1, the photosensitive member (A-9) had a post-irradiation potential of +119 V. The photosensitive member (A-9) inhibited generation of white spots in the formed image and exhibited particularly good sensitivity characteristics.

In contrast, the photosensitive layers of the photosensitive members (B-1) to (B-5) each contained any of the compounds (E7) to (E11) as the electron transport material. However, the compounds (E7) to (E11) were not encompassed by the compounds represented by general formulas (1), (2), (3), (4), and (5). Also, with respect to each of the photosensitive members (B-1) to (B-5), the charge of calcium carbonate as measured by charging the calcium carbonate through friction with the photosensitive layer was smaller than +6.5 μC/g. Therefore, with respect to each of the photosensitive members (B-1) to (B-5), a large number of white spots were observed in the formed image as shown in Table 2, indicating that the photosensitive member failed to inhibit generation of white spots.

The photosensitive layers of the photosensitive members (B-6) to (B-9) each contained any of the compounds (H10) to (H13) as the hole transport material. However, the compounds (H10) to (H13) were not encompassed by the compounds represented by general formulas (20), (21), (22), (23), (24), (25), (26), and (27). Furthermore, the photosensitive members (B-6) to (B-9) each had a Vickers hardness of the photosensitive layer at 45° C. of less than 17.0 HV. Therefore, with respect to each of the photosensitive members (B-6) to (B-9), a large number of white spots were observed in the formed image as shown in Table 2, indicating that the photosensitive member failed to inhibit generation of white spots.

The above results show that the photosensitive member according to the present disclosure inhibits generation of white spots in an image being formed. Also, the above results show that the process cartridge and the image forming apparatus according to the present disclosure inhibit generation of white spots in an image being formed.

What is claimed is:

1. An electrophotographic photosensitive member comprising a conductive substrate and a photosensitive layer having a single-layer structure, wherein the photosensitive layer contains a charge generating material, an electron transport material, a polycarbonate resin, and a hole transport material, a charge of calcium carbonate as measured by charging the calcium carbonate through friction with the photosensitive layer is at least +6.5 μC/g, in the measurement of the charge of the calcium carbonate, (i) two of the photosensitive layers are prepared, one of the two photosensitive layers being a first photosensitive layer, another of the two photosensitive layers being a second photosensitive layer, the first and second photosensitive layers each having a circular shape of a diameter of 3 cm, (ii) 0.007 g of the calcium carbonate is applied over the first photosensitive layer to obtain a calcium carbonate layer formed from the calcium carbonate, and the second photosensitive layer is overlaid onto the calcium carbonate layer, (iii) the first photosensitive layer is rotated at a rotational speed of 60 rpm for 60 seconds while the second photosensitive layer is kept stationary in an environment at a temperature of 23° C. and a relative humidity of 50% to charge the calcium carbonate contained in the calcium carbonate layer through friction between the calcium carbonate and each of the first photosensitive layer and the second photosensitive layer, and (iv) the charged calcium carbonate is sucked using a charge measuring device, and a total electric charge Q and a mass M of the sucked calcium carbonate are measured using the charge measuring device to calculate the charge of the calcium carbonate according to an expression Q/M, a Vickers hardness of the photosensitive layer at 45° C. is at least 17.0 HV, and the electron transport material includes a compound having a halogen atom and represented by general formula (4), and the hole transport material includes a compound represented by general formula (20), or the electron transport material includes a compound having a halogen atom and represented by general formula (1), and the hole transport material includes a compound represented by chemical formula (25-H6), or the electron transport material includes a compound having a halogen atom and represented by general formula (2), and the hole transport material includes a compound represented by general formula (27), (4)

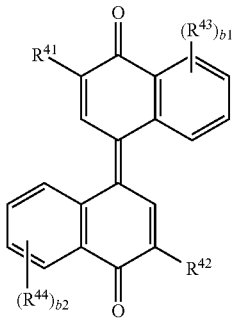

(2)

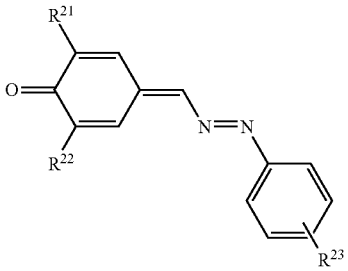

(3)

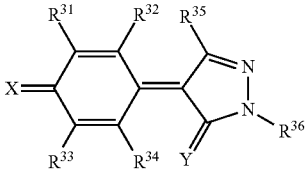

(4)

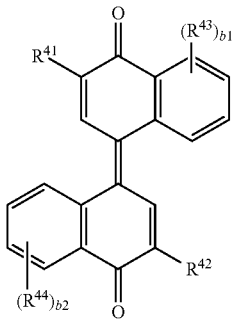

(5)

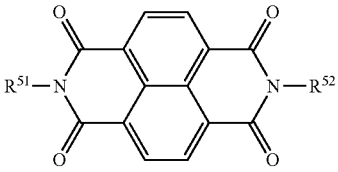

(20)

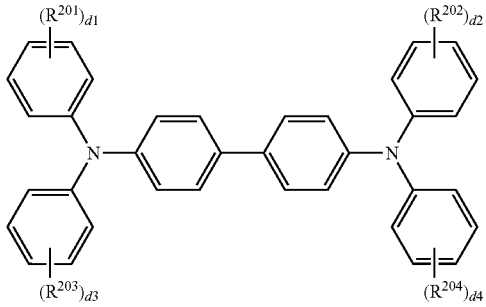

where in general formula (4), $R^{41}$ and $R^{42}$ each represent, independently of one another, an alkyl group having a carbon number of at least 1 and no greater than 8 and having at least 1 halogen atom or an aralkyl group having a carbon number of at least 7 and no greater than 20 and having at least 1 halogen atom, and b1 and b2 each represent 0, in general formula (20), $R^{201}$, $R^{202}$, $R^{203}$, and $R^{204}$ each represent, independently of one another, an alkyl group having a carbon number of at least 1 and no greater than 6, and d1, d2, d3, and d4 each represent, independently of one another, an integer of at least 0 and no greater than 5, (1)

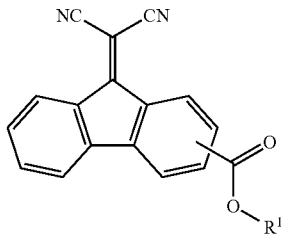

(25-H6)

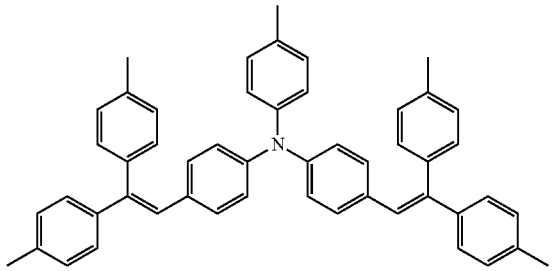

in general formula (1), $R^{1}$ represents an alkyl group having a carbon number of at least 1 and no greater than 8 and having at least 1 halogen atom, (2)

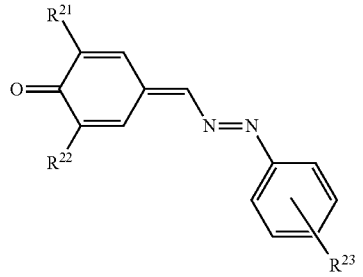

(27)

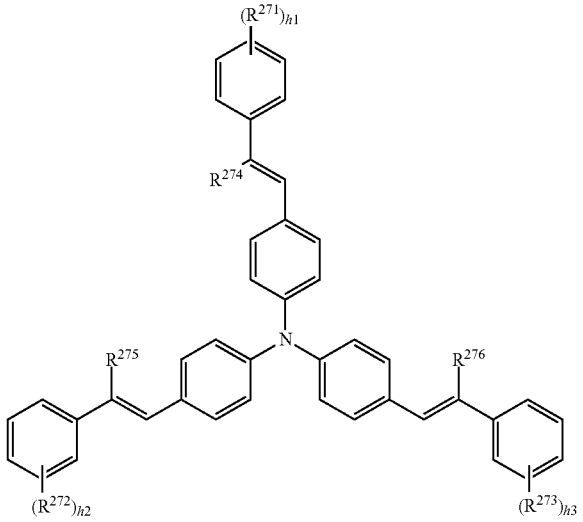

in general formula (2), $R^{21}$ and $R^{22}$ each represent, independently of one another, an alkyl group having a carbon number of at least 1 and no greater than 4, and $R^{23}$ represents a halogen atom, and in general formula (27), $R^{271}$, $R^{272}$, and $R^{273}$ each represent, independently of one another, an alkyl group having a carbon number of at least 1 and no greater than 6, h1, h2, and h3 each represent, independently of one another, an integer of at least 0 and no greater than 5, and $R^{274}$, $R^{275}$, and $R^{276}$ each represent, independently of one another, a hydrogen atom or an aryl group having a carbon number of at least 6 and no greater than 14.

2. The electrophotographic photosensitive member according to claim 1, wherein the electron transport material includes the compound represented by general formula (4), and the hole transport material includes the compound represented by general formula (20), and the compound represented by general formula (4) is a compound represented by chemical formula (4-E4) or (4-E5), and the compound represented by general formula (20) is a compound represented by chemical formula (20-H1)

(4-E4)

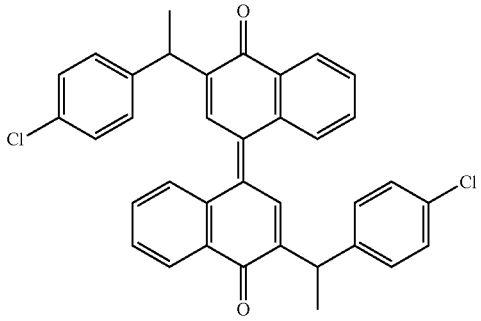

(4-E5)

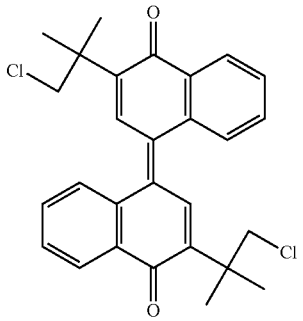

(20-H1)

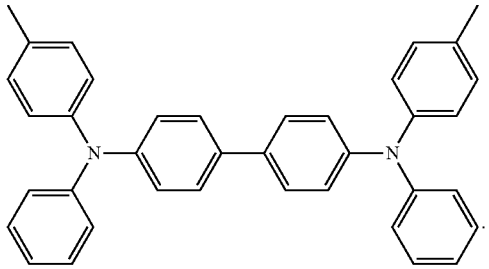

3. The electrophotographic photosensitive member according to claim 1, wherein the electron transport material includes the compound represented by general formula (2), and the hole transport material includes the compound represented by general formula (27), and the compound represented by general formula (2) is a compound represented by chemical formula (2-E2), and the compound represented by general formula (27) is a compound represented by chemical formula (27-H9)

(2-E2)

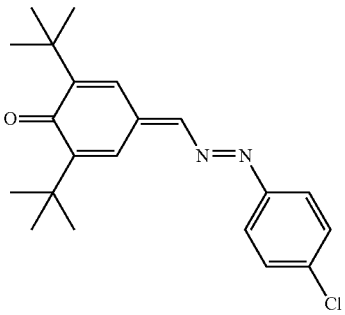

-continued
(27-H9)
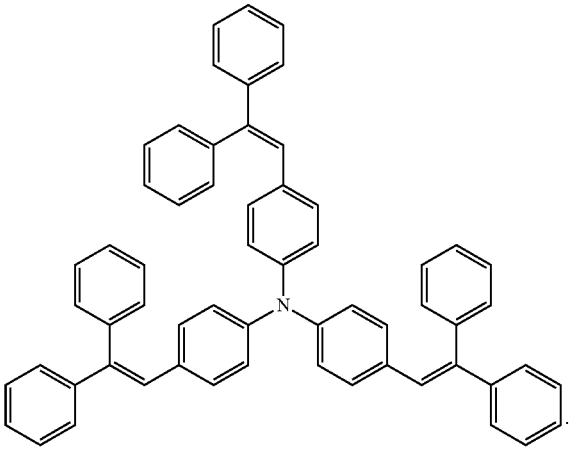
* * * * *